US005960652A

United States Patent [19]

Marmstad

[11] Patent Number: 5,960,652

[45] Date of Patent: Oct. 5, 1999

[54] WIRE LOCK

[76] Inventor: Jan Marmstad, Box 100, 611 23 Nykoping, Sweden

[21] Appl. No.: 09/121,967

[22] Filed: Jul. 24, 1998

Related U.S. Application Data

[63] Continuation-in-part of application No. 09/043,994, filed as application No. PCT/SE97/00209, Feb. 12, 1997.

[51] Int. Cl.[6] ..... E05B 67/06

[52] U.S. Cl. ..... 70/49; 70/30; 70/233

[58] Field of Search ..... 70/30, 49, 233, 70/14, 18, 19

[56] References Cited

U.S. PATENT DOCUMENTS

| | | | |
|---|---|---|---|
| 2,574,967 | 11/1951 | Gossner | 70/49 |
| 4,033,160 | 7/1977 | Mima | 70/233 |
| 4,037,441 | 7/1977 | Ray | 70/233 |
| 4,665,724 | 5/1987 | Sakai | 70/30 |
| 4,896,517 | 1/1990 | Ling | 70/18 |
| 5,144,821 | 9/1992 | Ernesti et al. | 70/159 |
| 5,369,970 | 12/1994 | Voiculescu et al. | 70/240 |
| 5,598,727 | 2/1997 | White | 70/233 |

FOREIGN PATENT DOCUMENTS

| | | | |
|---|---|---|---|
| 82785 | 2/1921 | Austria | 70/49 |
| 174161 | 3/1953 | Germany | 70/49 |
| 1058402 | 5/1959 | Germany . | |

*Primary Examiner*—Suzanne Dino Barrett
*Attorney, Agent, or Firm*—H. Jay Spiegel

[57] ABSTRACT

A locking device for locking unattached objects to e.g. a stationary part of a building or for locking objects to one another, has a lock casing (1) in which a drum (2) is mounted for rotation during unwinding and winding-on of a strap, a line, or preferably a wire (5), the free end of which preferably is provided with an end piece (6) adapted to be inserted to an opening in the lock casing (1) and to be secured with the aid of a lock (7). The drum (2) is connected to a knob (9) by means of which a wire (5) may be wound onto the drum (2) and be tensioned by a desired tensioning force. The knob (9) is connected to the drum (2) via coupling means (2.2, 9.2) and in its non-actuated position, the knob (9) disconnected from the drum (2). When the end piece (6) is locked within the casing (1), the drum (2) is simultaneously locked against rotation in an unwinding direction.

18 Claims, 19 Drawing Sheets

WIRE LOCK

This application is a Continuation-in-Part of Ser. No. 09/043,994, filed Jul. 6, 1998 filed as PCT/SE97/00209, Feb. 12, 1997.

BACKGROUND OF THE INVENTION

The present invention relates to embodiments of a wire lock. In the prior art, it is known to provide a locking mechanism including a casing containing a drum on which a length of cable or chain is wound, which device allows the cable or chain to be unreeled from the casing extended about an object and latched. Such devices are often unreliable in operation, are easily broken due to their manufacture from unhardened materials, and have short useful lives.

The following prior art is known to Applicant:

U.S. Pat. No. 2,574,967 to Gossner discloses a flexible shackle padlock having a drum carrying a flexible steel tape or chain wound thereon and which may be unwound, wrapped about an object and fastened to the casing. A key is positively coupled to the drum and may be rotated to either wind up the flexible tape or chain or unwind it. The present invention differs from the teachings of Gossner as including a winding knob that must be reciprocated into a coupled position before it may be used to rotate a drum. Furthermore, the present invention contemplates a mechanism that simultaneously locks the end of a wire cable in the casing while preventing drum rotation.

U.S. Pat. No. 4,896,517 to Ling discloses a wire lock having self-retractable wire including a combination lock actuator for the latch mechanism including a push button that may be depressed when the proper combination has been entered to release the end of the cable from its recess in the casing. A clutch mechanism may be locked to prevent release when the end of the cable is locked in the casing. The present invention differs from the teachings of Ling as contemplating a mechanism wherein a handle must be depressed to couple it with the cable drum to allow the handle to turn the drum and, wherein a clutch mechanism for the drum is completely internal within the casing.

U.S. Pat. No. 5,144,821 to Ernesti et al. discloses a portable lid lock that includes a cable drum having a hook at its end that is designed to latch under a lip of an appliance such as, for example, a washing machine or dryer to preclude the cover of the appliance from being opened. The present invention differs from the teachings of Ernesti et al. as contemplating a device wherein the end of the cable is latched within the casing itself and including a unique mechanism, in several embodiments thereof, precluding rotation of the cable drum when the cable is so latched.

U.S. Pat. No. 5,369,970 to Voiculescu et al. discloses a compartment lock similar to that of Ernesti et al. including a cable drum carrying a cable having a hook at its end and designed to lock a compartment lid such as the hood of a motor vehicle. The present invention differs from the teachings of Voiculescu et al. as contemplating latching the end of a cable to a recess within the device casing and including a unique mechanism, in several embodiments thereof, precluding rotation of the cable drum when the cable is so latched.

German Offenlegungsschrift 3543201 to Sakai discloses a locking device having a casing in which a rotatable drum is disposed carrying a cable that may be extended from the casing wrapped around an object and then inserted into an opening in the casing whereupon a lock may be activated to lock the cable end within the casing. When the end of the cable is so locked within the casing, a clutch mechanism externally disposed on the housing is prevented from releasing from the drum. A combination lock is employed to release the cable end. The present invention differs from the teachings of Sakai as contemplating a self-contained device wherein the clutch mechanism thereof is completely encased within the casing and is not accessible, thus being resistant to tampering.

DESCRIPTION OF THE INVENTION

The present invention relates to a locking device for securing unattached objects to e.g. a stationary part of a building, or for locking objects to one another, comprising a lock casing in which a drum is mounted for rotation during unwinding and winding-on of a strap, a line, or preferably a wire, the free end of which preferably is provided with an end piece adapted to be inserted into an opening in the lock casing and to be secured with the aid of a lock therein.

The locking device in accordance with the introductory part comprises a lock casing having a bottom piece and a lid, the lock proper being arranged in the lid. The lock may be a conventional key-operated lock but preferably it is a combination lock having setting means to produce combinations of numbers allowing the lock to be opened. The end piece attached to the wire of the locking device is arranged to be secured when the lock is brought to the locking position and to be disconnected as the lock is opened. The end piece may be replaced by a loop-shaped part of the wire, a solution which, however, impairs the manageability of the locking device.

The locking device in accordance with the invention is characterized in that the drum in the lock casing is connected to a manually actuable knob which is mounted for rotational movement about rotational shaft coinciding with the rotational axis of the drum, and with the aid of which the wire may be reeled onto the drum and be tensioned by the desired tensioning force. Preferably, the knob is connected to the drum via coupling means, said knob, in its non-actuated position, being disconnected from the drum and in its actuated position being connected to the drum.

Preferably, the drum supports a gear which is connected to a pawl arm which, when the wire is being wound-on is arranged to snap against the teeth of the gear and when pulling forces are exerted on the wire is arranged to block the drum against rotation. The pawl arm is connected to a locking arm on the lock and is arranged to turn out of contact with the gear when the locking arm is turned to the open position. The drum is also affected by a band spring, i.e. a so called spiral spring, which is wound about a centre and arranged to be tightened as the wire is being unwound from the drum and to counter-rotate the drum when the wire is being wound-on as long as the wire travels into the lock casing essentially without resistance.

When the wire, owing to spring actuation, is wound onto the drum the knob is pressed against the lock casing sufficiently to cause engagement of the coupling means, whereupon the drum may be tightened manually to achieve the desired wire tension. The winding-on of the wire onto the drum, by spring action on the drum or through manual actuation of the knob of the locking device, is effected in a position, in which the wire end piece is inserted in the lock casing and secured thereto owing to the lock having been caused to assume a locking position. This arrangement means that locking of the end piece may be affected in a position, wherein the wire is effected only by the spring force and that the tensioning of the wire may be effected separately from the locking operation. Consequently, the locking operation may be performed directly following the application of the wire around the objects to be secured. It is possible to subsequently readjust the wire and on the one hand to post-tighten it manually around the objects and on the other to tighten it with the aid of the knob on the locking device.

By the expression wire should be understood in this connection all kinds of flexible elements, such as lines, straps and the like which additionally are manufactured from a material that can be severed only with difficulty. For this reason, the wire preferably is made from steel wire but which is coated by a plastic cover in order not to damage the objects to be secured.

The lock casing is also manufactured from a strong material, such as steel, and it is assembled in such a manner that the means for separating the casing are accessible only by removal of the lock when the latter assumes its unlocked position.

DESCRIPTION OF THE DRAWING FIGURES

The invention will be described in the following by way of one embodiment with reference to the accompanying drawings.

SPECIFIC DESCRIPTION OF THE PREFERRED EMBODIMENTS

Figure 1:
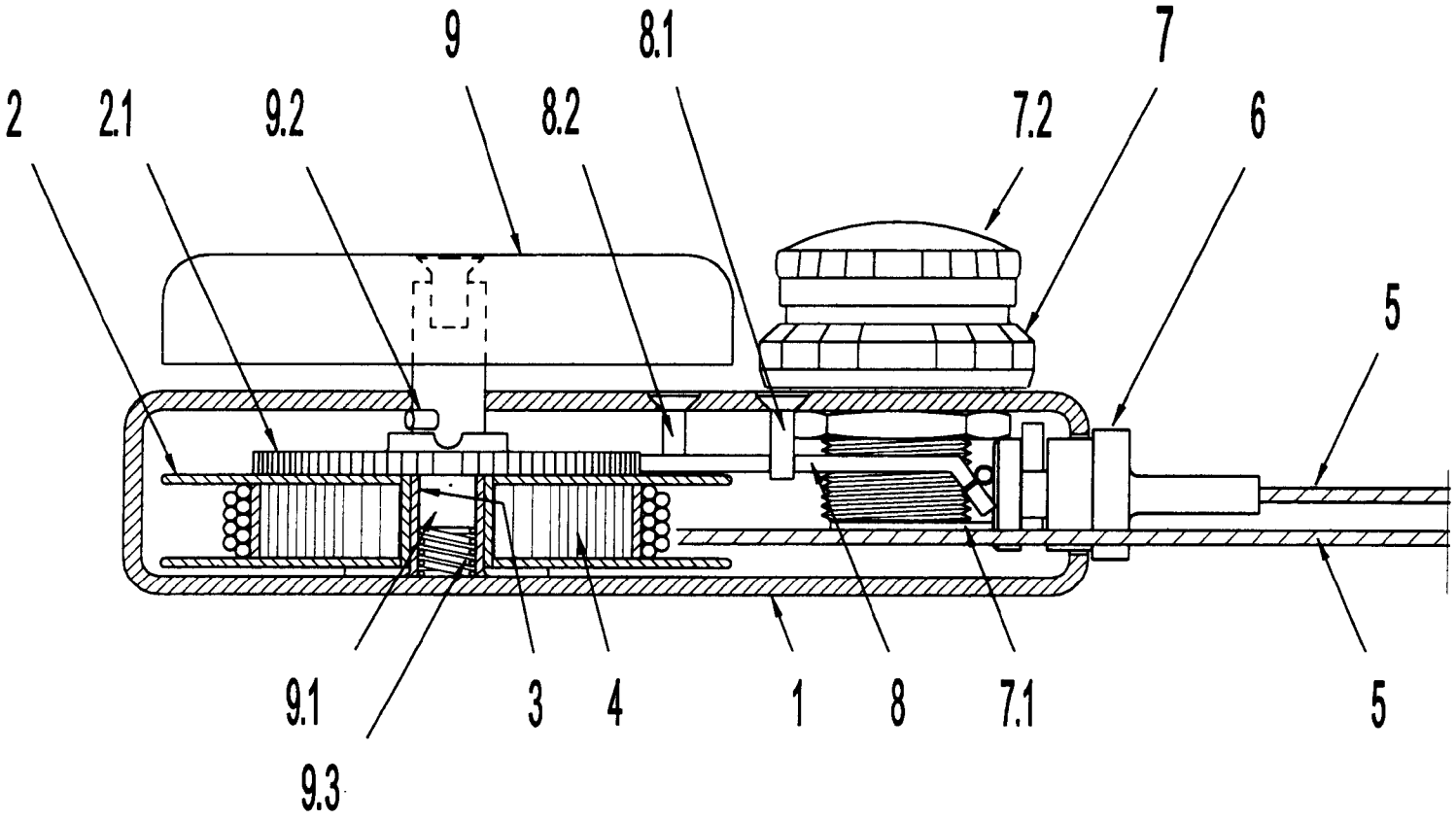
FIG. 1 shows a wire lock in a longitudinal sectional view through a shaft of a wire drum forming part of the device.
Figure 2:
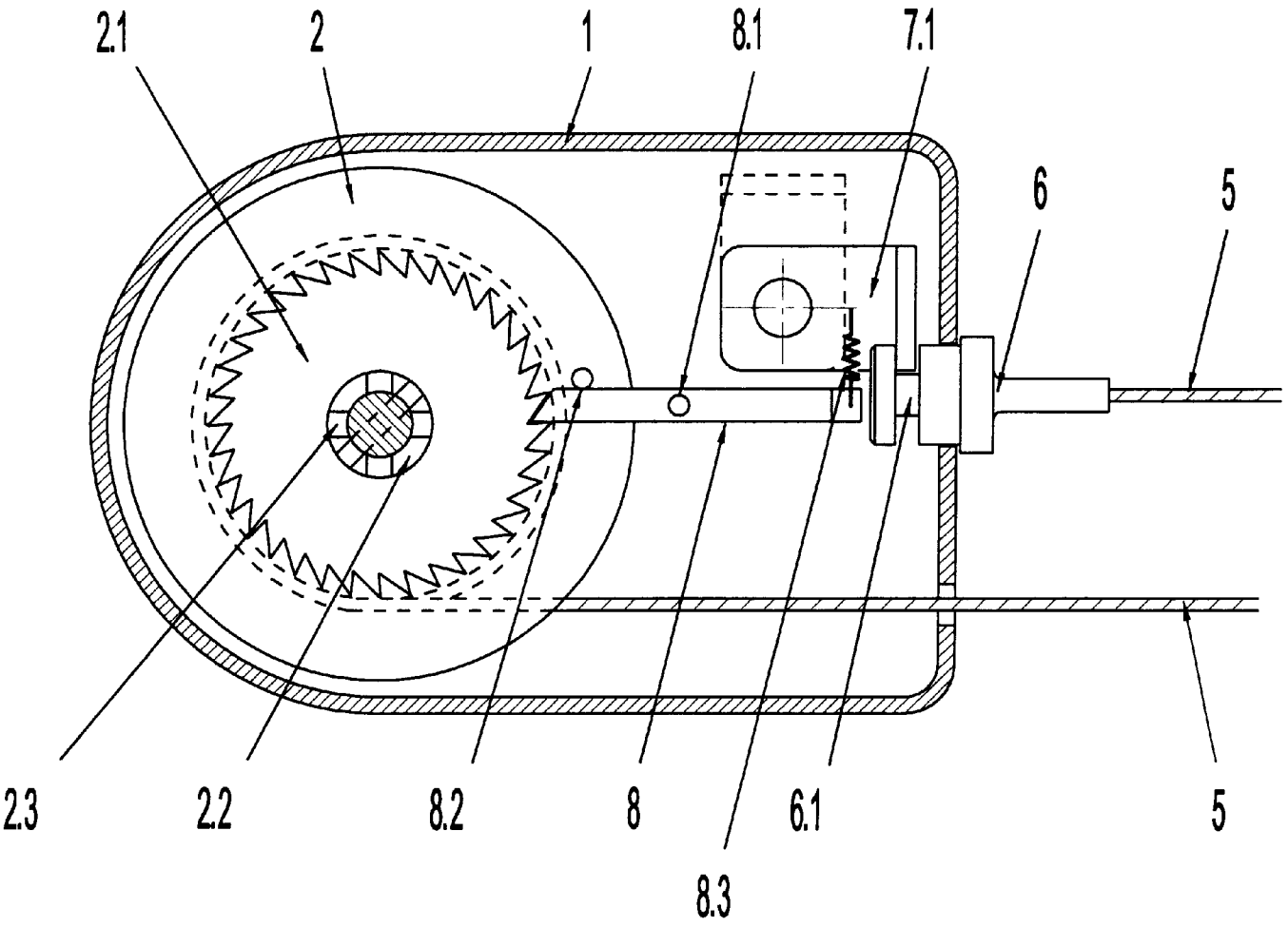
FIG. 2 illustrates the wire lock device in accordance with FIG. 1 as seen in the axial direction of the wire drum.
Figure 3:
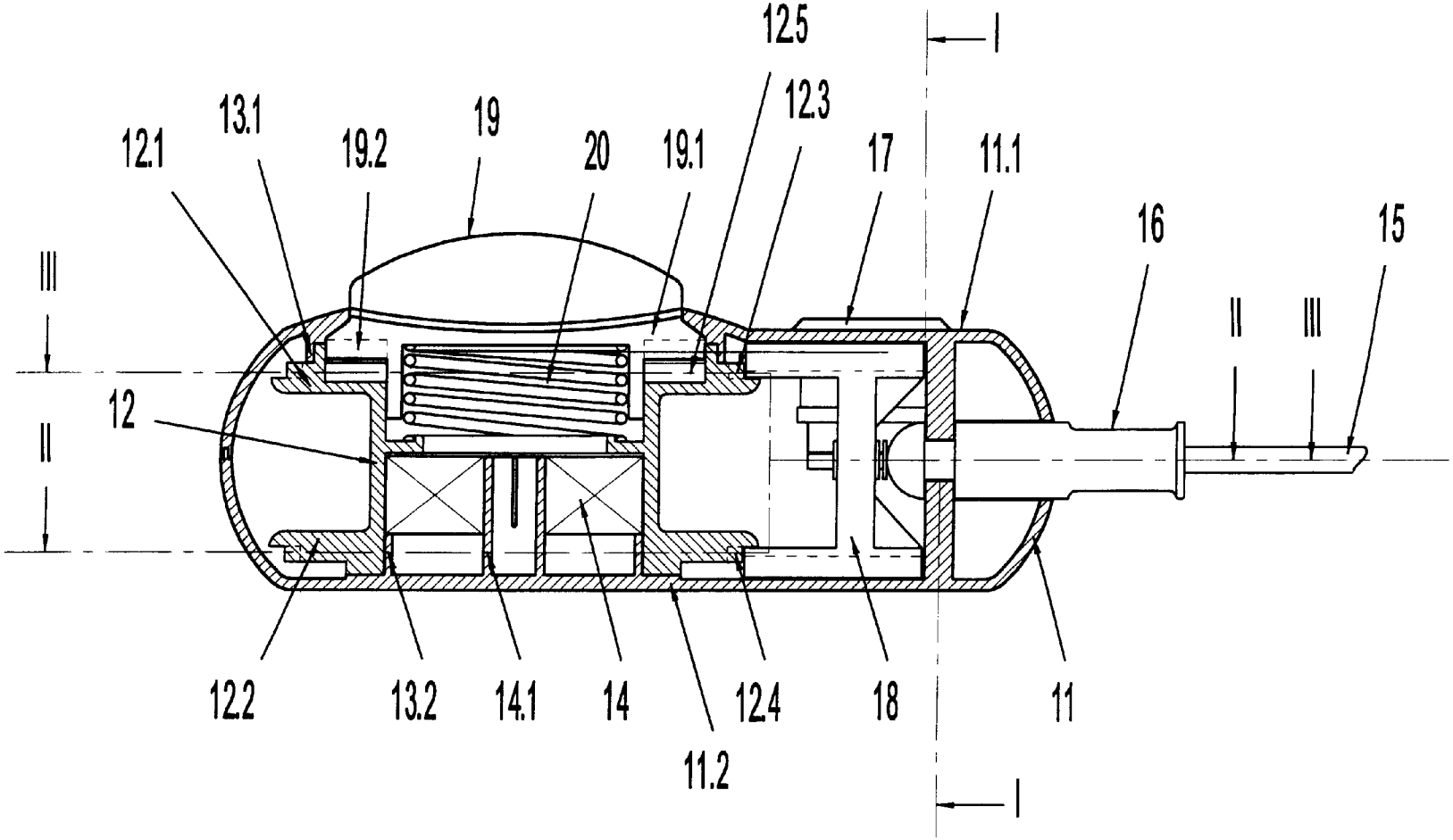
FIG. 3 illustrates a wire lock device in accordance with an alternative embodiment in a longitudinal sectional view similar to the one in FIG. 1.
Figure 4:
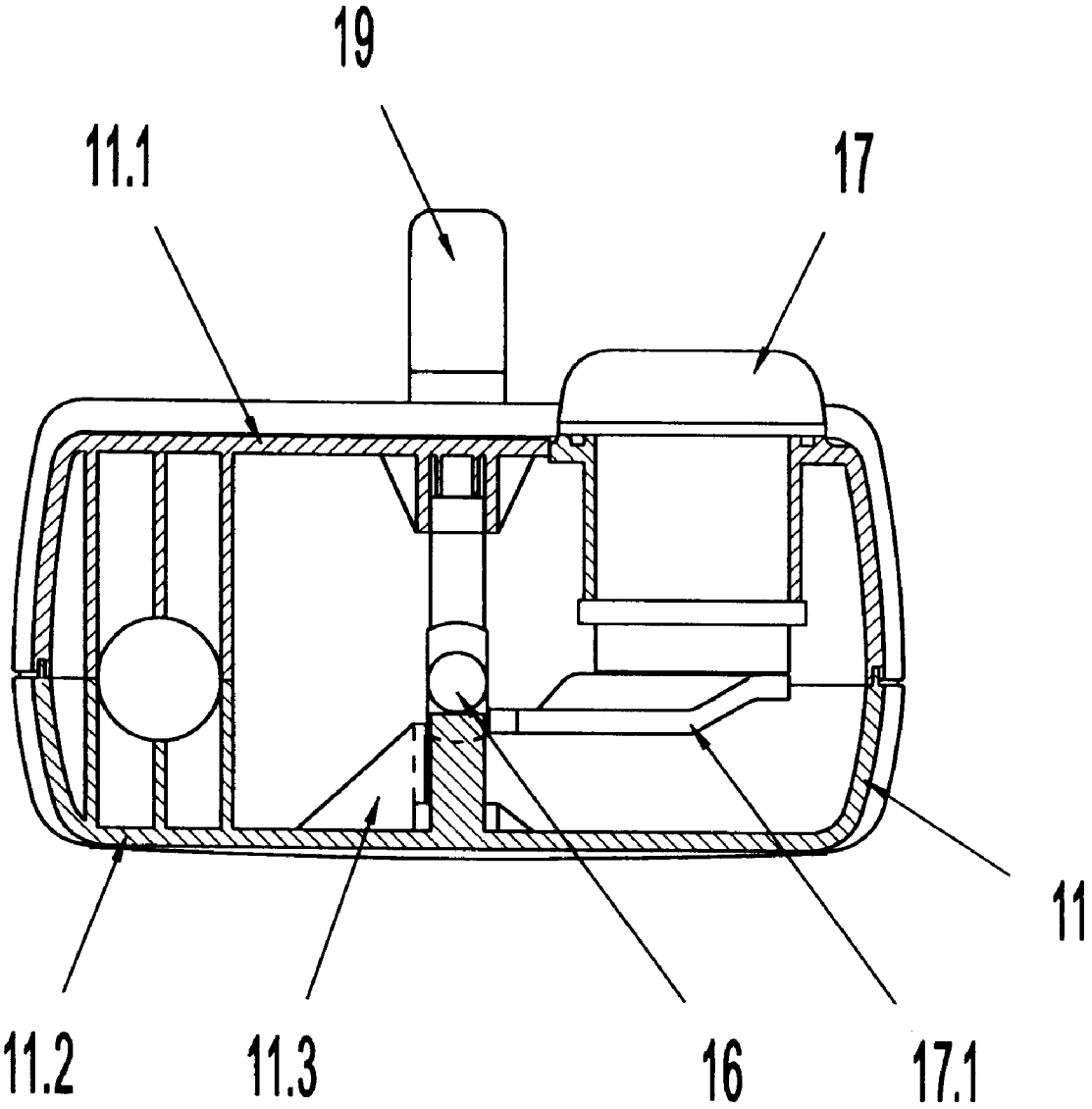
FIG. 4 is a cross-sectional view of the alternative embodiment of the wire lock, the section being taken on line I—I of FIG. 3.

The wire lock device illustrated in FIGS. 1 and 2 comprises a lock casing 1 essentially of prisma configuration, in which casing a wire drum 2 is rotatably mounted about a sleeve-shaped stub axle 3 projecting from the bottom 1.2 in the lock casing 1.

The sleeve-shaped stub axle 3, illustrated in a longitudinal, sectional view in FIG. 1, serves as a means of attachment for the inner end of a band spring 4 the outer end of which is attached to the wire drum 2. In the retracted position, a wire 5 is wound around the wire drum 2 by means of the band spring 4, the latter being tightened as the wire 5 is being extracted out of the casing 1 while being unreeled from the wire drum 2. The wire 5 is intended to be applied around or through an object to be locked e.g. to a stationary building component or the like, and to be reinserted into the lock casing 1. For this purpose, its free end is formed with an end piece 6 adapted to be introduced into the lock casing wherein it is locked by means of a lock known per se after the wire having been drawn in the desired manner.

In the embodiment illustrated, the lock 7 is of combination-lock type which may be opened from a locked position in response to the setting of a predetermined combination of numbers. The lock 7 is connected to a locking arm 7.1 which is arranged on the bottom face of the lock and which is rotatable about a shaft extending perpendicularly through the upper face of the lock casing 1, upon rotation of a grip member 7.2 on the lock 7 between an opened position, wherein the locking arm 7.1 is turned outwards towards one of the long sides of the lock casing 1 as illustrated by dash-and-dot lines in FIG. 1, and a locked position, wherein the locking arm 7.1 is turned forwards, towards the opening or slot of insertion of the end piece 6 on the wire 5, and is introduced into a groove 6.1 formed in the part of the end piece 6 projecting inwards through the end wall of the lock casing 1, as illustrated in FIG. 1.

The wire drum 2 supports a gear 2.1 on the side thereof that is directed towards the lock 7. A bar pawl 8 is arranged for turning movements about a pin 8.1 extending in parallel with the axis of rotation of the wire drum 2, between an abutment 8.2 by means of which the bar pawl 8 engages the gear 2.1 on the wire drum 2 and released position, in which the bar pawl 8 is turned away from the gear 2.1. The free end of the bar pawl 8 is connected to the locking arm 7.1 by means of a spring 8.3 which in this position keeps the bar pawl 8 pressed against the abutment 8.2 when the locking arm 7.1 assumes the locking position, i.e. is inserted into the groove 6.1 in the end piece 6 on the wire 5. When the locking arm 7.1 is being turned to the opened position the spring force of spring 8.3 ceases and is replaced by a pulling force, pulling the bar pawl 8 away from the abutment 8.2 and into engagement with the gear 2.1.

A knob 9 is mounted on a shaft or pin 9.1 one end of which is positioned interiorly of the sleeve-shaped wire drum axle 3 and the opposite end of which projects beyond the lid of the lock casing 1. The knob shaft 9.1 is formed with a dog or follower pin 9.2 extending perpendicularly through the knob shaft 9.1 immediately interiorly of the lock casing 1 and being maintained pressed against the inner face of the lock casing 1 by a compression spring 9.3 arranged in the bottom of the sleeve-shaped axle 3. A coupling ring 2.2 having four open grooves 2.3 that are directed towards the dog 9.2 is arranged on the gear 2.1 in such a manner that the follower pin 9.2 may pass freely above the ring 2.2 when the compression spring 9.3 retains the knob shaft 9.1 pressed against the sleeve-shaped axle 3 in such a manner that the follower pin 9.2 is in contact with the lower face of the lid and maintains the knob shaft 9.1 inside the lock casing 1. The follower pin 9.2 is brought into engagement with the grooves 2.3 in the coupling ring 2.2 when the knob 9 is pressed manually inwards against the lock casing 1 and is turned. Since the coupling ring 2.2, the gear 2.1 and the wire drum 2 are mutually nonrotationally interconnected the wire drum 2 may be turned manually by means of the knob 9, the bar pawl 8 "snapping" i.e. travelling or riding on the teeth of the gear 2.1 without blocking the latter against rotational movement.

In a starting position the lock 7 is locked and retains the end piece 6 in its position of insertion in the lock casing 1. When the wire lock is to be used, the lock 7 is opened by setting pre-selected combinations of numbers and turning the lock to the opened position with the aid of the grip member 7.2. In this position, the end piece 6 may be extracted from the lock casing 1 and the wire 5 may be pulled out while being unreeled from the wire drum 2 since the bar pawl 8 simultaneously is turned out of contact with the gear 2.1 on the wire drum 2. The wire 5 is drawn around or through the object to be secured and, as the case may be, also about a stationary object, a vehicle or some other object that is difficult to move, whereupon the end piece 6 is inserted into the opening in the lock casing 1 while at the same time the lock 7 is turned to the locked position. The wire drum 2 is affected by the force of the band spring 4, paying in slack wire 5 until said wire is tightened somewhat, which occurs while the bar pawl 8 "snaps", i.e. travels or rides across the teeth of the gear 2.1. In this position, wherein the force of the band spring 4 is no longer capable of pulling in further lengths of wire 5 the knob 9 is depressed manually, resulting in the follower pin 9.2 on the knob pin 9.1 being moved into engagement with two of the grooves 2.3 in the coupling ring 2.2 on the gear 2.1 and the wire drum 2. When the knob 9 is being turned while in its depressed position, further lengths of wire 5 are made to be wound onto the wire drum 2, tightening the wire 5 further. It is now impossible to pull the wire out of the lock casing 1 since the bar pawl 8 is in engagement with the gear 2.1 on the wire drum 2 while simultaneously abutting against the abutment 8.2.

Figure 5:
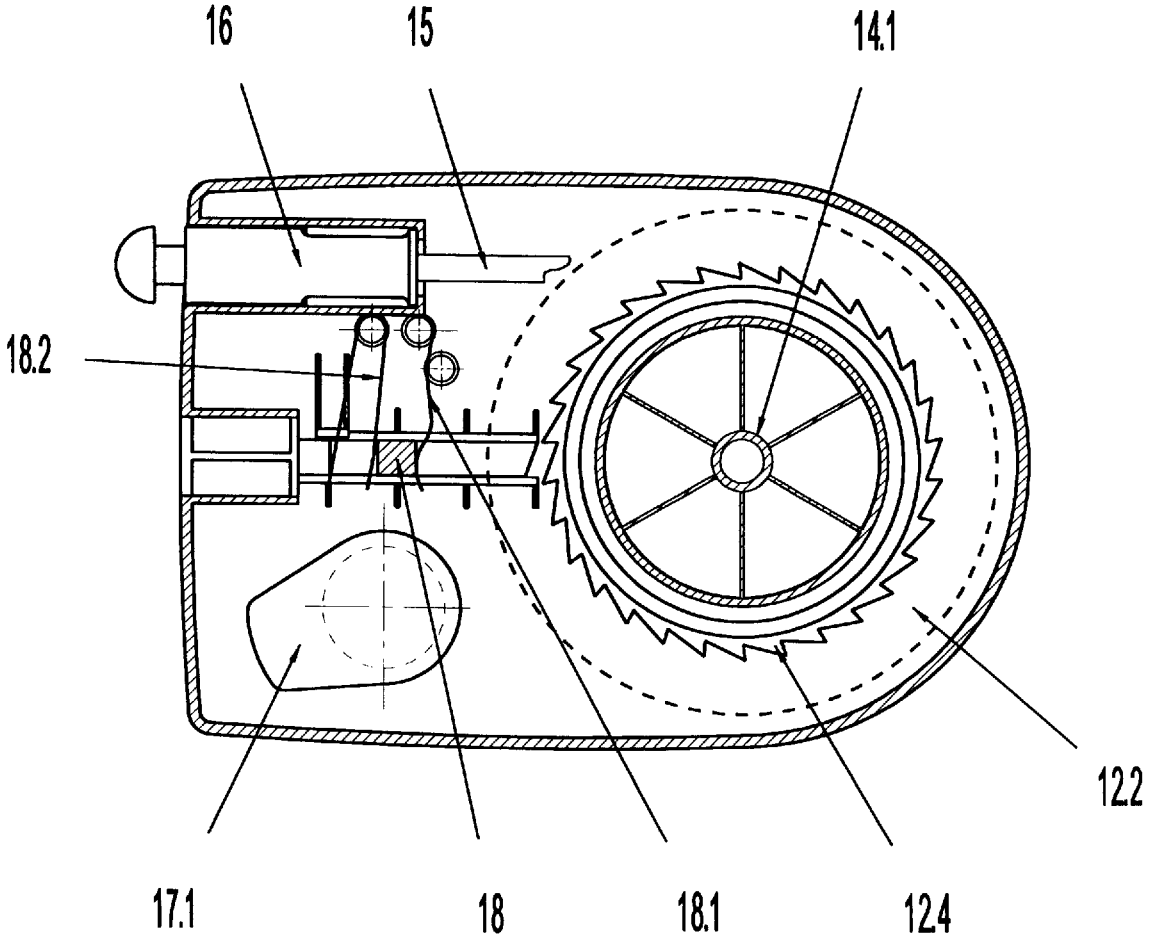
FIG. 5 is a longitudinal sectional view of the alternative embodiment of the wire lock, the section being taken on line II—II of FIG. 3.

The wire lock in accordance with the alternative embodiment illustrated in FIGS. 3–6 comprises a two-part lock casing 11 comprising a lid 11.1 and a bottom piece 11.2, in which casing a wire drum 12 is rotatably mounted in an outer mount 13.1 forming a part of the lid 11.1, and of the bottom 11.2. A band spring 14 is wound on a sleeve 14.1 placed centrally in the wire drum 12 and forming a means for attachment of the inner end of the band spring 14. The outer end of the band spring is connected to the wire drum 12. The band spring 14 is indicated only by the crossed boxes in FIG. 3. A wire 15, in its retracted condition, is wound onto the wire drum 12 by means of the band spring 14 and at its free end it is formed with an end piece 16 which is adapted to be inserted into the locked casing 11, wherein it is locked by means of a lock 17 after the wire 15 having been applied in the desired manner around an object to be secured. In accordance with this embodiment the end piece 16 has a T-shaped end having a rectangular cross-sectional shape and intended to be inserted into a rectangular lock opening formed in the lock casing 11 and to be turned therein over 90° to a locked position, in which the cross bar of the T-shape is caused to engage behind stationary parts of the lock casing. In this manner pulling forces exerted on the wire 15 in the locked position thereof will be absorbed by the material of the lock casing 11 whereas the lock 17 as such remains unaffected by these forces. The lock 17 is connected to a locking arm 17.1 on the lower face of the lock, which is rotatable upon turning of the key appertaining to the lock 17, not illustrated in the drawing figures, about a shaft, extending perpendicularly through the upper face of the lock casing 11, between an open position, wherein the locking arm 17.1 is turned outwards towards one side of the lock casing 11, as illustrated in FIG. 5, and a locked position, illustrated in FIG. 6, in which the locking arm 17.1 is turned forwards towards the insertion slot and the end piece 16. In the locked position, the locking arm 17.1 prevents the end piece 16 from being turned to such a degree that it may be pulled out of the inserted slot in the lock casing.

Figure 6:
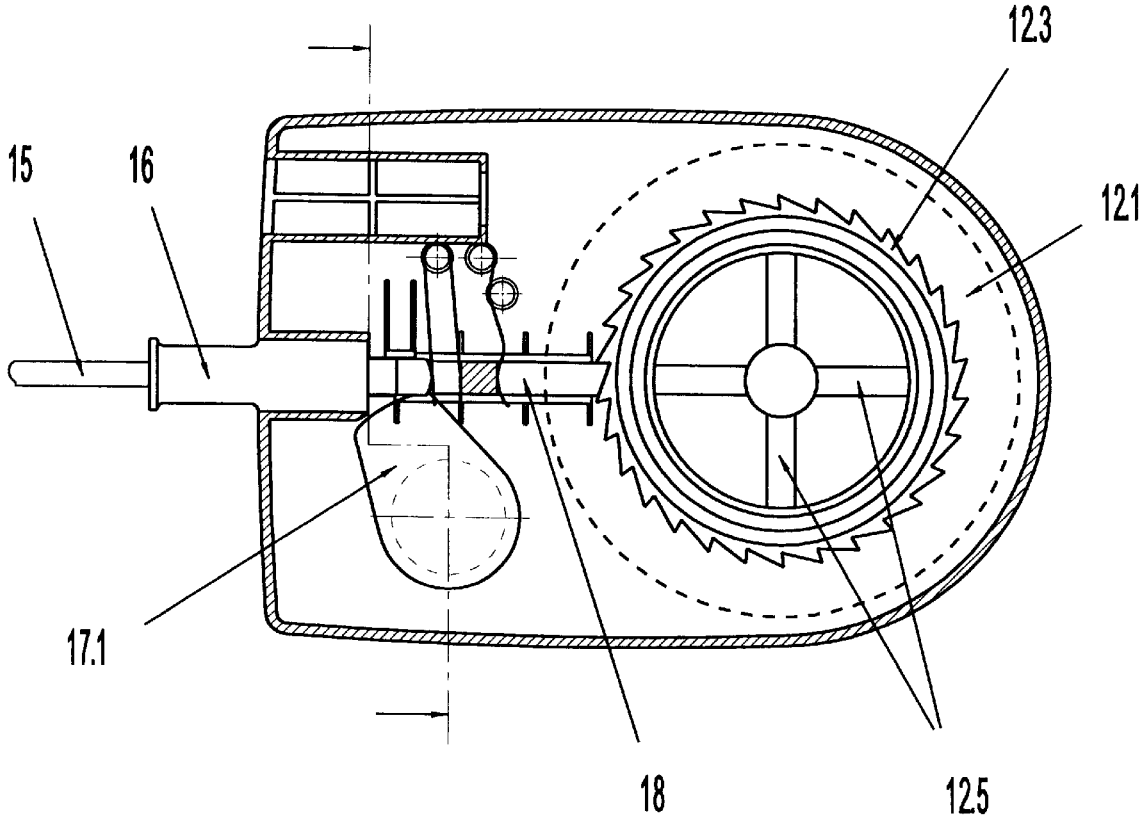
FIG. 6 is a longitudinal sectional view of the alternative embodiment of the wire lock, the section being taken on line III—III of FIG. 3.

The wire drum 12 has a U-shaped cross-section including an upper flange 12.1 and a lower flange 12.2. On the outer face of the upper flange 12.1 an upper gear 12.3 is provided, and on the outer face of the lower flange 12.2 a lower gear 12.4 is provided. An H-shaped bar pawl 18, arranged to engage in the respective gears 12.3, 12.4, is linearly displaceable between a released position, wherein the bar pawl 18 is displaced away from the gears 12.3, 12.4 as illustrated in FIG. 5, to a locked position, wherein the bar pawl 18 is in contact with the gears 12.3, 12.4, blocking the wire drum 12 against rotation as illustrated in FIG. 6. The bar pawl 18 is affected on the one hand by an opening spring 18.1 which is rigidly connected to the lock casing 11 and shaped as a tongue exerting a force on the cross bar of the bar pawl 18, which force is directed outwards, away from the wire drum 12, and also by a closing spring 18.2 which is rotatably connected with the lock casing and formed as two parallel spring leaf legs arranged between the end piece 16 and the cross bar of the bar pawl 18 and which allows "snapping" of the bar pawl 18, i.e. riding across the teeth in contact with the gears 12.3, 12.4 on the wire drum 12 upon rotation of the latter as the wire 15 is being retracted. Owing to this spring arrangement the rotation of the wire drum 12 may, in a blocked position, wherein the locking arm 17.1 is in the locked position, be prevented in one direction, i.e. from reeling-out of the wire 15 from the wire drum 12, while the wire drum 12 is simultaneously allowed to be rotated in the opposite direction with the aid of a knob 19 as the wire 15 is being tensioned.

The knob 19 is mounted in mounts in the lock casing 11 and in the upper flange 12.1 on the wire drum 12, respectively, and is kept pressed against the inner face of the lock casing 11 by means of a helical spring 20. The knob 19 is formed with an annular flange 19.1 extending in a plane in parallel with a plane through the upper flange 12.1 of the wire drum 12 and comprising teeth 19.2 which upon depression of the knob 19 in the lock casing 11 may be caused to engage in corresponding grooves 12.5 formed in the upper flange 12.1 of the wire drum 12.

In the starting position the end piece 16 is kept in the retracted condition in a storage recess formed in the lock casing 11, as illustrated in FIG. 5. When the wire lock is to be used, the end piece 16 and the wire 15 are extracted from the wire drum 12, the bar pawl 18 simultaneously assuming a released position owing to the opening spring 18.1, out of contact with the gears 12.3, 12.4. The wire 15 is applied about and through the object to be secured, whereupon the end piece 16 is inserted into the lock opening and turned over 90° so that its bars engage behind stationary parts of the lock casing 11. The key is then turned in the lock 17 in such a manner that the locking arm 17.1 blocks the end piece 16 against rotation. The wire drum 12 is affected by the force of the band spring 14, reeling-in slack wire 15, which is effected while the arm pawl 18 "snaps" against the teeth of the gears 12.3, 12.4 against the action of the closing spring 18.2. In the position, wherein the force of the band spring 14 no longer is able to pull in further lengths of wire 15 the knob 19 is depressed manually, causing its teeth 19.2 to engage with the grooves 12.5 on the upper flange 12.1 of the wire drum 12, whereupon the knob 19 is turned, causing further length of wire 15 to be wound onto the wire drum 12 under snapping action until the wire 15 is tightened additionally. The shaped part of the end piece 16 is illustrated in its locked position in FIGS. 4 and 6 and it is blocked against rotation on the one hand by the locking arm 17.1 in the lock 17 and on the other by abutment against a stop shoulder 11.3 formed in the bottom 11.2 of the lock casing 11.

The cable lock in accordance with the alternative embodiment illustrated in FIGS. 7–12, consists of a two-part outer casing comprising a lid 21.1 and a bottom 21.2, a cable drum 22 being rotatably mounted inside said casing in an outer mount 23.1 also forming part of the lid 21.1 and in the lower end of an inner mount 23.2 forming part of the bottom 21.2. A band spring 14 is wound on a sleeve 24.1 positioned centrally in the cable drum 22 and forming an attachment means securing the inner end of the band spring 14.

The outer end of the band spring is connected to the cable drum 22. The band spring is indicated only by crossed boxes in FIG. 7. As an alternative, the band spring may be placed in a separate cartridge 22.7 which is pressed into the cable drum 22 and is prevented from rotational movement relative to the cable drum by means of locking protrusions (not visible). This arrangement facilitates the assembly operation. In accordance with the alternative the outer end of the band spring is connected to the cartridge. The end wall of the cartridge is arranged in a plane intermediate the band spring 14 and the bottom 21.2 of the external casing and prevents the band spring, which has a tendency to bulge axially on account of its intrinsic tension, from contacting the bottom 21.2. This arrangement reduces undesirable noise otherwise produced when the outer end of the band spring rotates relatively to the bottom, causing wear thereon, and also reduces the friction between the cable drum and the bottom. In order to further reduce the friction the end wall of the cartridge is formed with ribs 22.8 on its outer face. One wall 22.9 of the cable drum 22 extends in a plane perpendicularly to the centre shaft of the drum and is disposed immediately above the band spring 14, an arrangement preventing the band spring, due to its intrinsic tension, from contacting the ring holder having a collar 24.2 and causing wear thereon during rotation, which would create undesirable noise and friction losses.

In its retracted condition a cable 25 is wound onto the cable drum 22 by means of a band spring 14 and on its free end it is formed with an end piece 26 intended to be inserted into the lock casing 21 wherein it is fastened by means of a lock 17 after the cable having been applied around an object in the desired manner. The end piece 26 in accordance with the embodiment illustrated in FIG. 10 has a T-shaped end having a rectangular cross-sectional shape intended to be inserted into a rectangular lock slot formed in the lock casing 21 wherein it is turned over 90° to a locked position, in which the cross bar of the T-shape is caused to engage behind stationary parts of the lock casing 21. A pulling force exerted on the cable 25 in the locked condition thus will be absorbed by the material of the lock casing 21 and be transferred to the lid 21.1 and the bottom 21.2 whereas the lock 17 as such remains unaffected by these forces.

Figure 8:
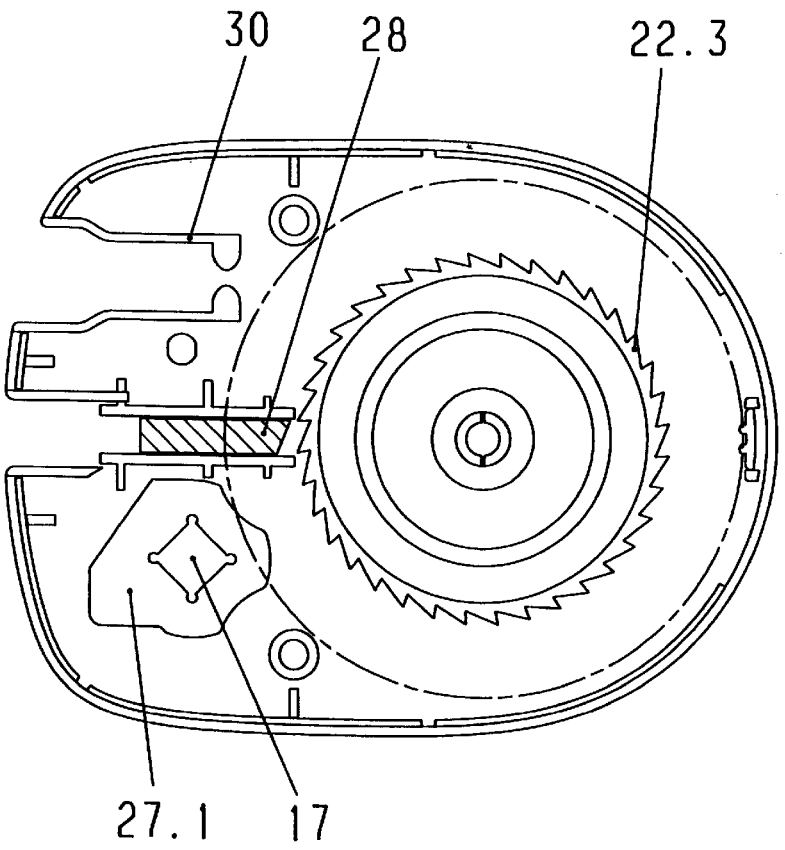
FIG. 8 is a cross-sectional view of the embodiment of the wire lock of FIG. 7, the lock being shown in the unlocked position.
Figure 9:
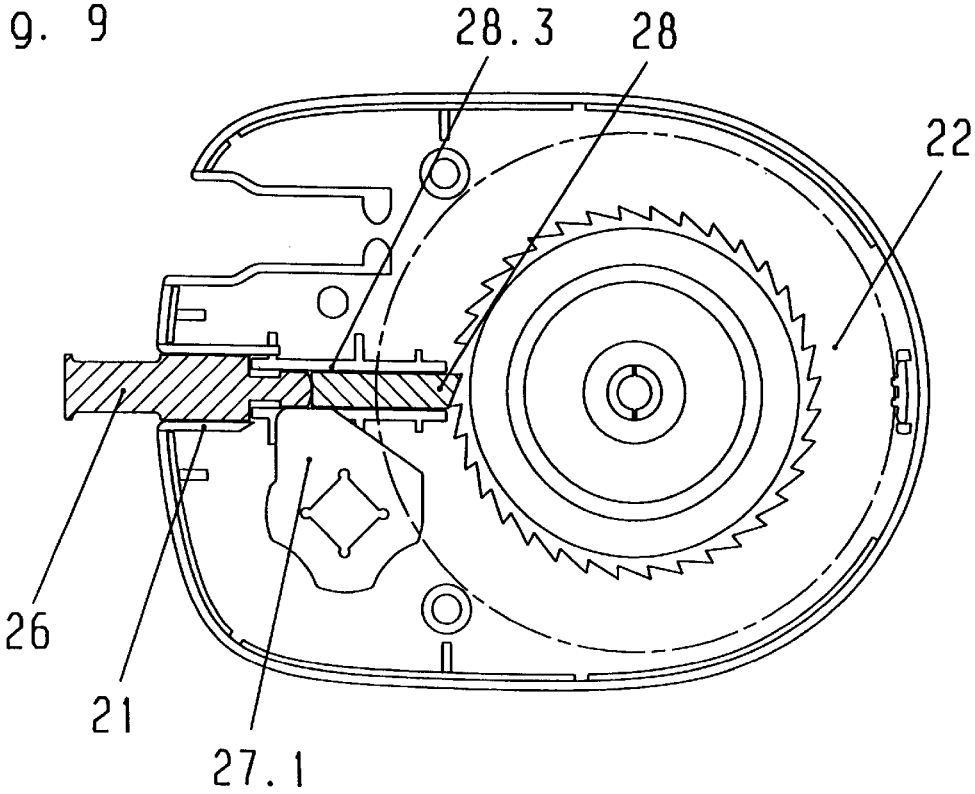
FIG. 9 is a cross-sectional view of the embodiment of the wire lock of FIG. 7, the lock being shown in the locked position.

The lock 17 is connected to a locking arm 27.1 on the lower face of the lock, which arm may be rotated by turning a key appertaining to the lock 17, not illustrated in the drawing figures, about an axis extending perpendicularly to the parting line of the external casing, between an opened position, wherein the locking arm 27.1 is turned outwards towards one side of the bottom piece as illustrated in FIG. 8, and a locked position, illustrated in FIG. 9, in which the locking arm 27.1 is turned forwards towards the insertion slot and the end piece 26. In the locking position the locking arm 27.1 prevents the end piece 26 from being turned which would allow it to be withdrawn from the insertion slot in the lock casing 21.

The cable drum 22 has a U-shaped cross-sectional configuration including an upper flange 22.1 and a lower flange 22.2. On the outer face of the upper flange 22.2 an upper gear 22.3 is provided, as illustrated in FIG. 8, and on the outer face of the lower flange 22.2 a lower gear 22.4 is provided. An H-shaped bar pawl 28, arranged for engagement with the respective gears 22.3 and 22.4 is linearly displaceable between a released position, in which the bar pawl is displaced away from the gears 22.3 and 22.4, as illustrated in FIG. 8, and a locking position wherein the bar pawl is in contact with the gears 22.3 and 22.4, blocking the cable drum 22 against rotation, as illustrated in FIG. 9. The arm pawl is affected (FIG. 7) on the one hand by two opening springs 28.1 of helical type acting against the lock casing 21 and applying a force on the bar pawl leg ends that are directed away from the cable drum 22, and on the other by a closing spring 28.2 of leaf spring type which is affected by the end piece and which transfers the centrally acting force of the end piece 26 to the outer end of the cross bar of the pawl. The spring allows "snapping" action, i.e. riding of the bar pawl 28 across the teeth in contact with the gears 22.3 and 22.4 on the cable drum 22 as the later rotates to pull in the cable 25. Owing to this spring arrangement it is possible in a locked position wherein the locking arm 27.1 assumes the locking position, to prevent rotation of the cable drum 22 in one direction, i.e. against withdrawal of cable 25 from the cable drum 22 while at the same time the cable drum 22 may be turned in the opposite direction with the aid of a knob 29 upon tensioning of the cable 25.

In accordance with an alternative embodiment the closing spring 28.2 of leaf type is replaced by a spring of helical type. The latter is affected directly by the ball-shaped end (not shown in the drawing figure) of the end piece 26.

The knob 29 is mounted in supports formed in the upper casing 21.1 and in inner part of the cable drum 22, respectively, and is kept pressed against the inner face of the upper casing 21.1 by means of a helical spring 20. The knob 29 has an annular flange 29.1 extending in parallel with a plane through the upper flange 22.1 of the cable drum 22 and being formed with teeth 29.2 which, upon depression of the knob 29 in the upper casing 21.1, may be caused to engage in corresponding grooves 22.5 formed in the upper flange 22.1 of the cable drum 22.

In the starting position, the end piece 26 is maintained in its retracted position by the cable 25 inside a storage sleeve 30 in the locking device, as illustrated in FIG. 8. When the locking device is to be used the end piece 26 and the cable 25 are withdrawn from the storage sleeve from the cable drum 22 while at the same time the bar pawl 28, actuated by the opening springs 28.1, is moved to the position, out of contact with the gears 22.3 and 22.4. The cable 25 is applied about or through the object to be secured, whereupon the end piece 26 introduced into the lock opening and is turned over 90° ensuring that the cross bars of the end piece engage behind stationary parts of the lock casing 21. The key is then turned in the lock 17 whereby the locking bar 27.1 blocks the end piece against turning movements.

Figure 10:
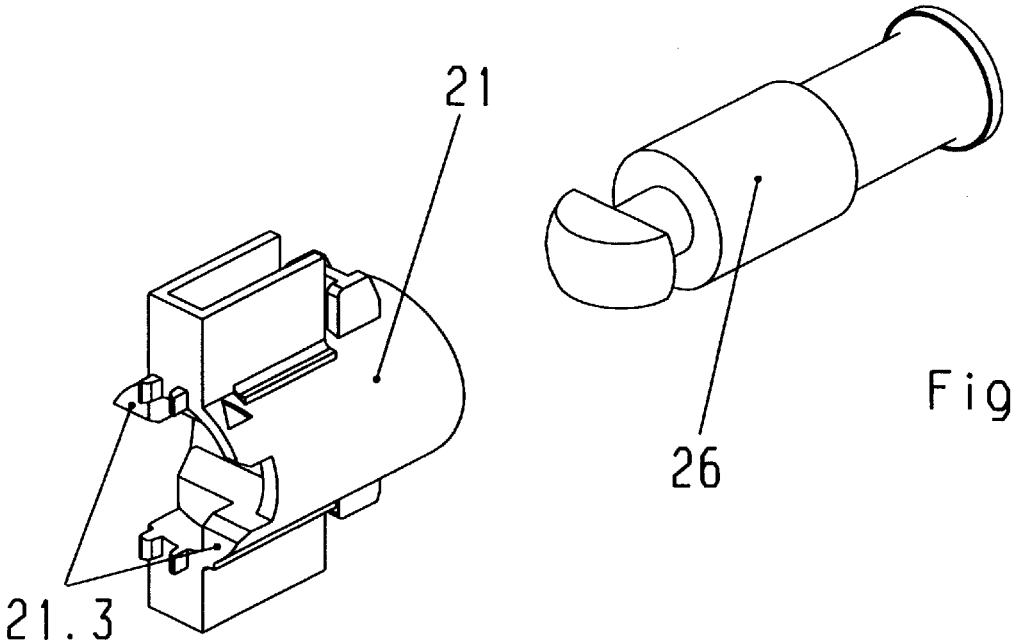
FIG. 10 illustrates an embodiment of the lock casing and the end piece in an unlocked position.
Figure 11:
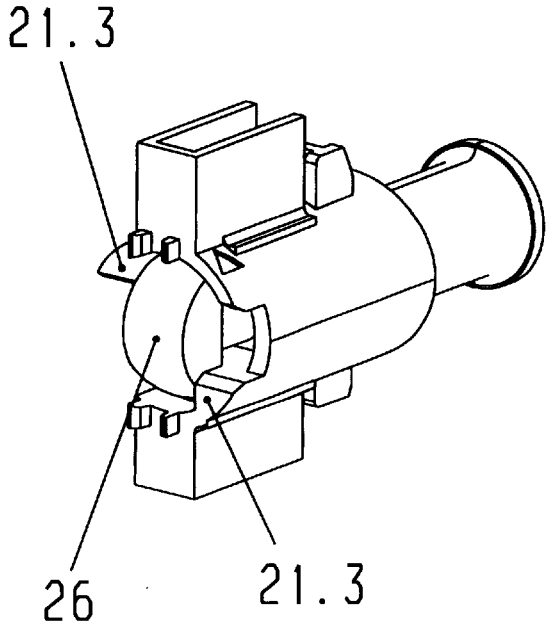
FIG. 11 illustrates the lock casing and the end piece of FIG. 10 in a locked position.

The cable drum 22 is affected by the force of the band spring 14 and reels-in slack lengths of cable 25, which is effected while the bar pawl 28 "snaps" against the teeth 22.3 and 22.4 of the gear against the action of the locking spring 28.2. In this position, when the force of the band spring 14 no longer is able to pull in further lengths of cable 25, the knob 29 is depressed manually to ensure that its teeth 29.2 engage in the grooves 22.5 in the upper flange 22.1 of the cable drum 22, whereupon the knob 29 is turned, causing further lengths of cable 25 to be wound onto the cable drum 22 under "snapping" action, until the cable is tensioned further. The T-shaped part of the end piece 26 is illustrated in its locked position, blocked against rotational movement, in FIG. 9, which is effected on the one hand by means of the locking arm 27.1 on the lock 17 and on the other by the abutment against two stop shoulders 21.3 provided at the end of the lock casing, as illustrated in FIGS. 10–11.

Figure 12:
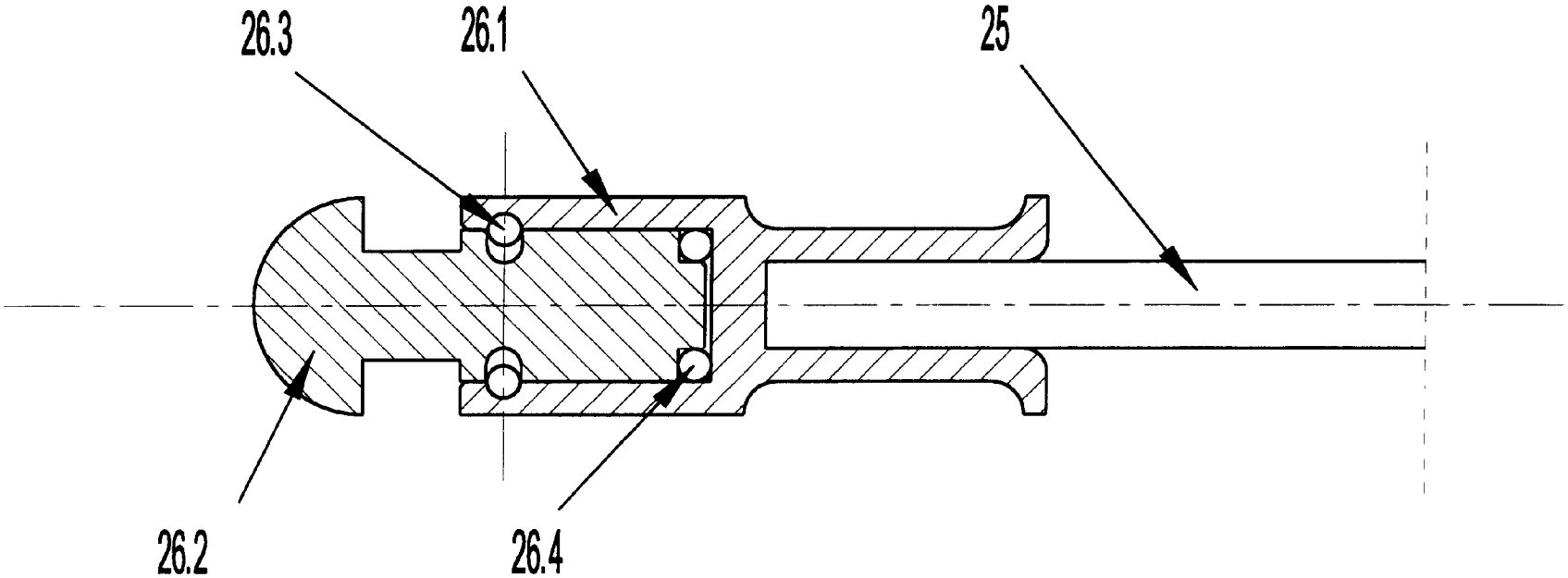
FIG. 12 illustrates an alternative embodiment of the end piece.

In accordance with FIG. 12, the end piece 26 has a built-in "skidding" function, preventing inner parts of the locking device from excessive loads and from being damaged, should the end piece 26 be turned by external brutal force thereon, for instance, with the aid of a tool. The end piece comprises a cylinder 26.1 inside of which rides the T-shaped end ball 26.2 of the end piece. A locking ring 26.3 maintains the end ball 26.2 in the predetermined position thereof. A friction ring 26.4 or, alternatively, a spring of helical type, urges the end ball 26.2, while exerting a calibrated force, away from the closed end of the cylinder against the locking ring 26.3, thus producing a moment of friction. When the external sleeve is turned, the moment of torsion transferred to the end ball 26.2 cannot exceed the moment of friction determined by the force of the friction ring 26.4.

Preferably, the cable 25 comprises an inner core of multifilament stainless steel wire which is able to transfer considerable traction forces and can only be severed by means of a heavy tool. The steel wire is enclosed in a layer of braided aramid fibres (Kevlar fibres), also able to transfer considerable traction forces and making severing of the cable additionally difficult while at the same time preventing the surface of the objects to be secured by means of the cable from being scratched by the steel wire. In addition, the aramid fibre may be given different colours to match the colours of the cable lock. The end of the cable that is attached to the cable drum is formed with a securely anchored stop means (not shown) which is moved into contact with the storage sleeve 30 immediately before complete withdrawal of the cable. In this manner, the force of the cable, when the cable is fully extracted, cannot be transferred to the cable drum 22 but via the storage sleeve 30 to the external casing of the cable lock. This arrangement prevents damage to the cable drum and the band spring.

A structural detail facilitating the use of the cable lock is that the cable 25, when having been unwound to be applied around or through an object, may be maintained in its extracted position by depression of the knob 29 against the cable drum 22 and retention thereof in this position, the friction then arising between the knob and the cable drum preventing the cable 25 from being pulled-in into the lock device interior. When the cable has been secured in the desired manner, the knob 29 is released, whereby the cable will be reeled into the locking device to the extent allowed by the spring force.

With reference, now, to FIGS. 13–20, a further embodiment of the inventive wire lock will now be described. In many respects, the wire lock illustrated in FIGS. 13–20 is similar to the embodiment described above with reference to FIGS. 7–12. Certain individual structures of the embodiment of FIGS. 7–12 have been modified in manners to be described hereinbelow to create the embodiment of FIGS. 13–20. In describing the embodiment of FIGS. 13–20, like or corresponding elements will be referred to using like primed reference numerals.

Figure 13:
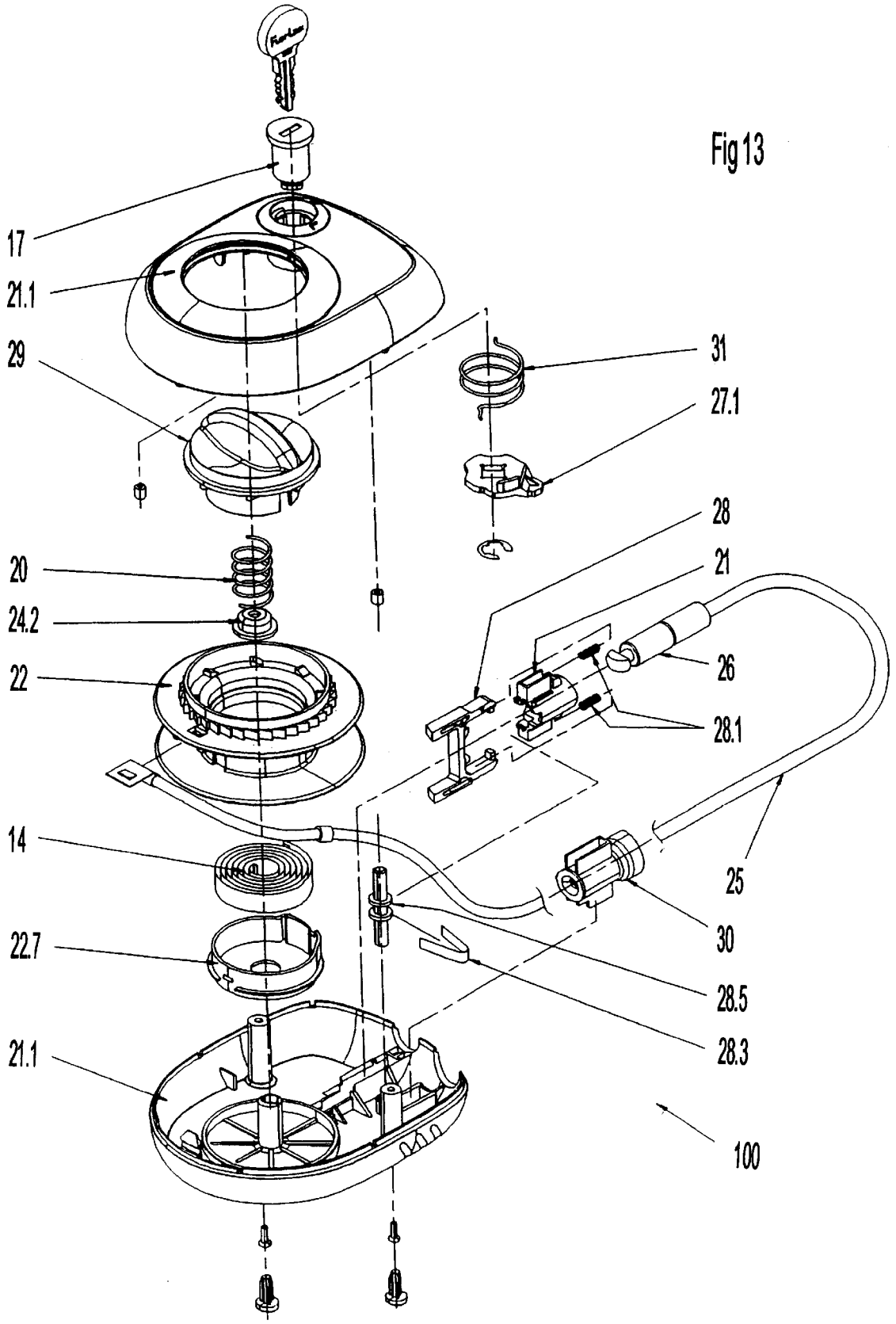
FIG. 13 shows an exploded perspective view of a fourth embodiment of the wire lock in accordance with the invention.

FIG. 13 shows an exploded perspective view of the fourth embodiment of the present invention which is generally designated by the reference numeral 100. FIG. 13 should be referred to in the specific discussion of FIGS. 14–20 to follow.

Figure 7:
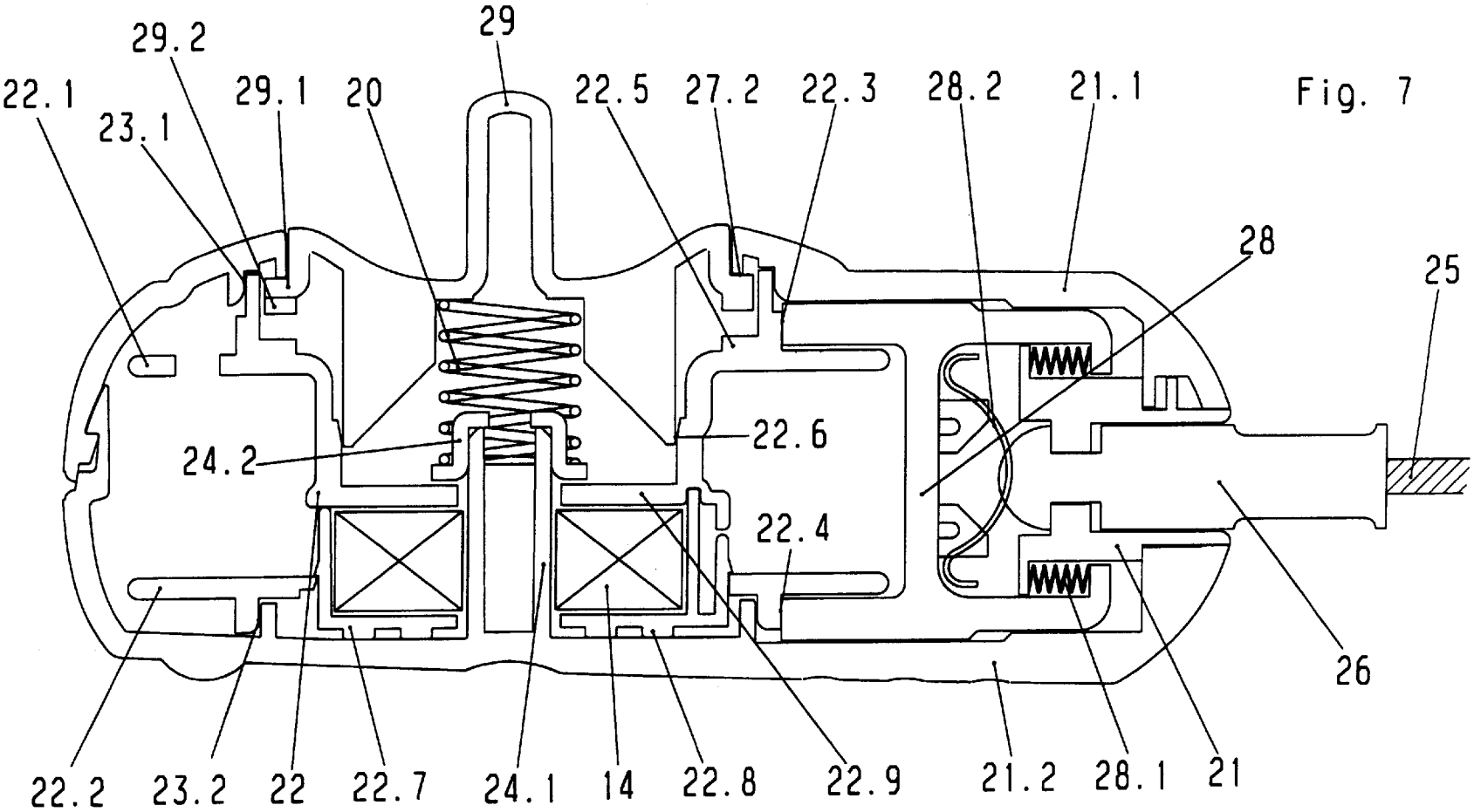
FIG. 7 illustrates a third embodiment of the wire lock in accordance with the invention in a longitudinal sectional view similar to the one illustrated in FIG. 1.
Figure 14:
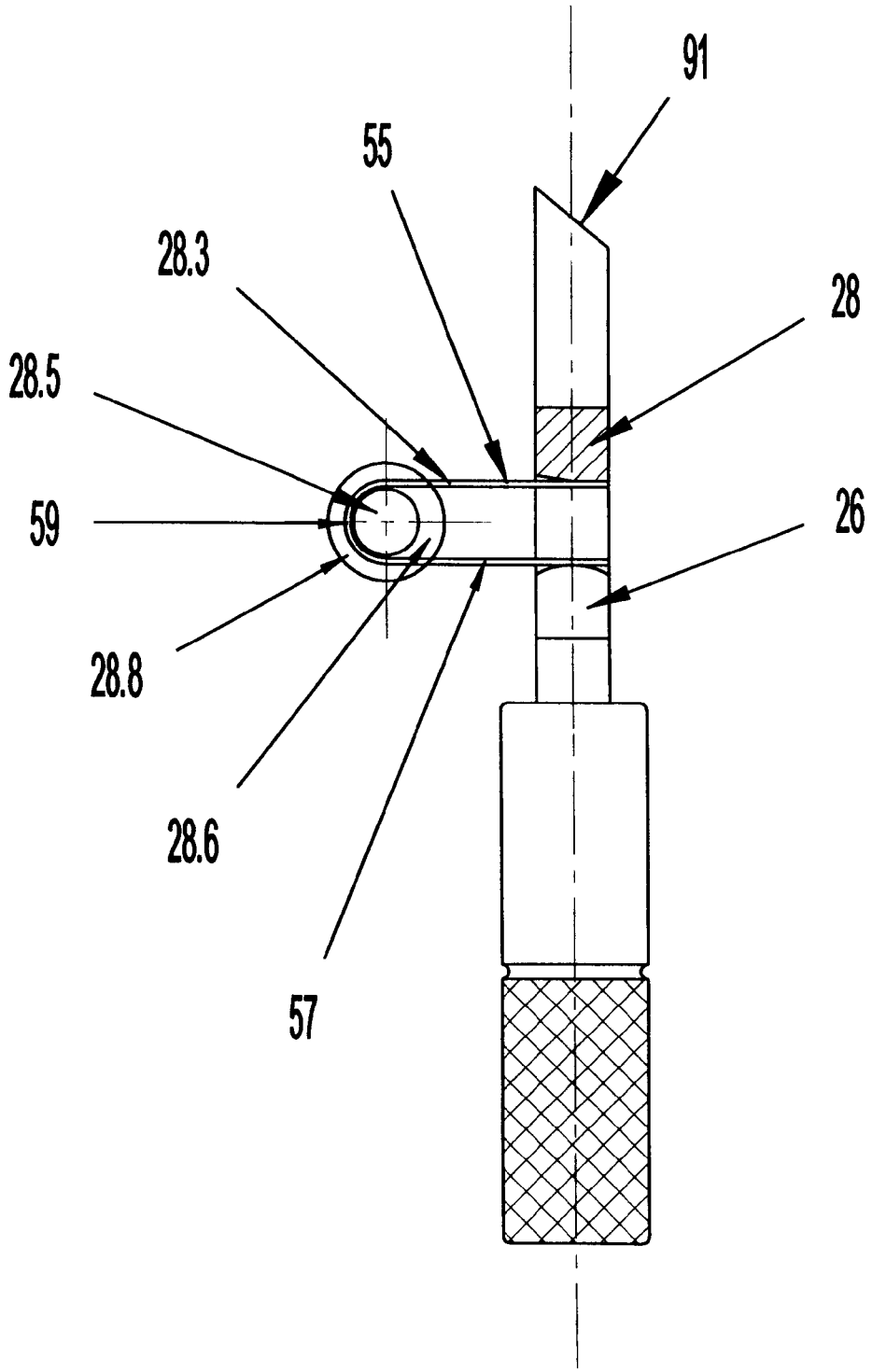
FIG. 14 shows a top view of a portion of the structure of the wire lock of FIG. 13 showing details of the end piece of the cable and a closing spring.
Figure 15:
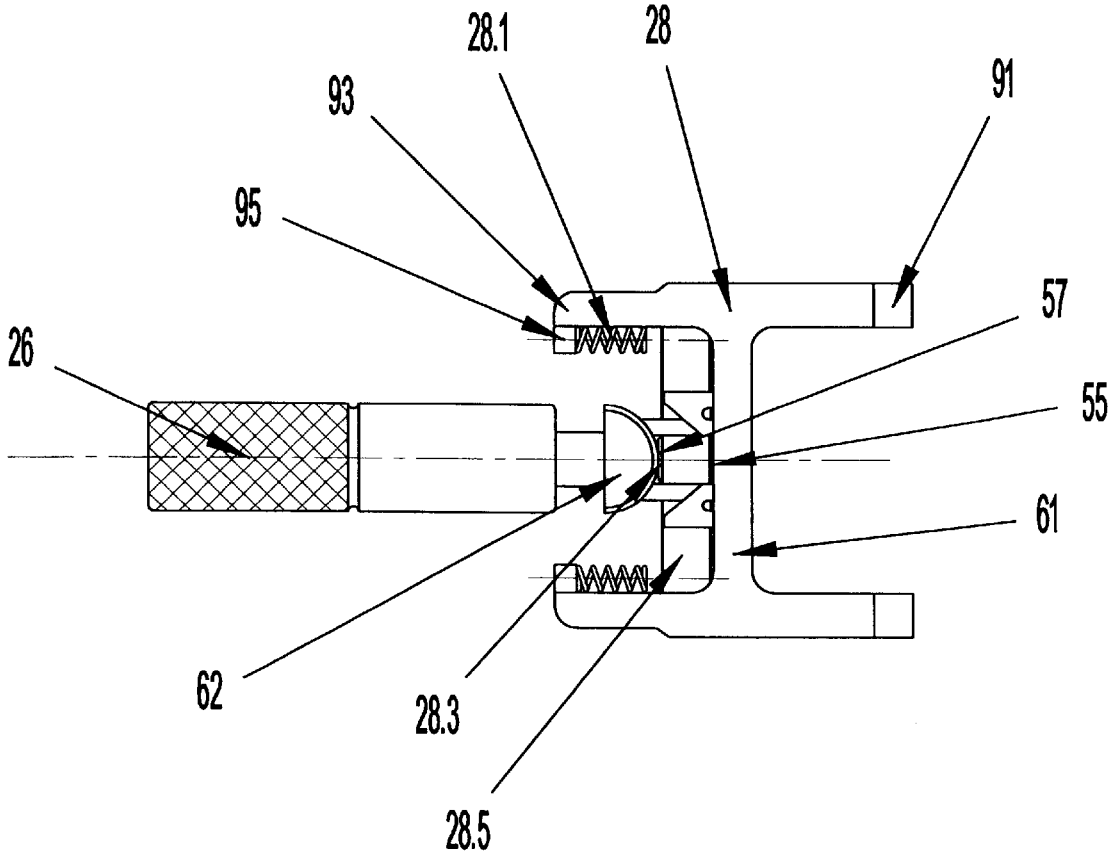
FIG. 15 shows a side view of the structure shown in FIG. 14.
Figure 21:
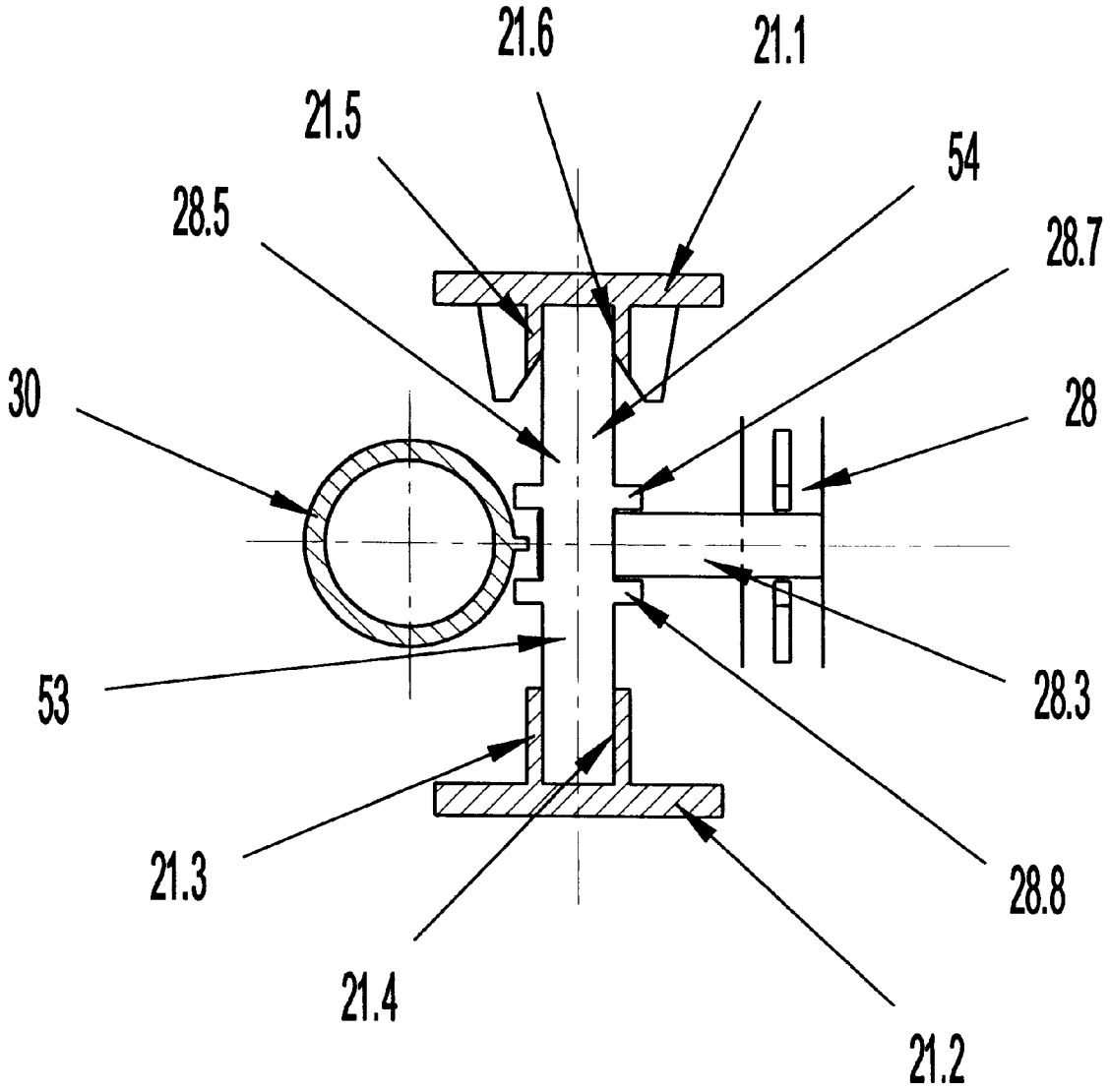
FIG. 21 shows details of mounting of a spring supporting post.

With reference, first, back to FIG. 7, the closing spring 28.2 is a leaf-type spring that transfers forces applied thereon by the end piece 26 to the H-shaped bar pawl 28. With reference to FIGS. 14 and 15, the leaf-type spring 28.2 may be replaced with a U-shaped spring 28.3 that is mounted on a post 28.5 (FIG. 13) having a recessed area 28.6 defined by an upper shoulder 28.7 and a lower shoulder 28.8 of which the lower shoulder 28.8 is also seen in FIG. 14. With reference to FIG. 21, the post 28.5 is supported within the housing halves 21.2 and 21.1 by structures integrally formed therein including the sleeve 21.3 having an opening 21.4 therein sized to receive the bottom end 53 of the post 28.5. A similar structure is also formed in the upper cover 21.1 including the sleeve 21.5 having an opening 21.6 therein that receives the upper end 54 of the post 28.5.

As seen in FIG. 14, the spring 28.3 includes legs 55 and 57 and a curved portion 59 extending about the recessed area 28.6. As seen in FIG. 15, an end of the leg 55 bears against the cross member 61 of the H-shaped bar pawl 28 while the end of the leg 57 bears against the end 62 of the end piece 26. As should be understood from FIG. 14, in particular, when the bar pawl 28 reciprocates in the downward direction in the view of FIG. 14, in response to rotations of the drum 22 as the cable 25 is tightened about an object through rotations of the handle 29, the peripheral teeth of the drum 22 engage a first end 91 of the bar pawl causing reciprocations of the bar pawl 28 which result in flexing of the leg 55 of the spring 28.3, which leg 55 biases the bar pawl in a direction of movement in the upward direction in the view of FIG. 14. A second end 93 of the bar pawl 28 has inwardly directed protrusions 95 engaged by springs 28.1 to bias the bar pawl toward the opening in the casing through which the end piece 26 may be inserted.

Figure 16:
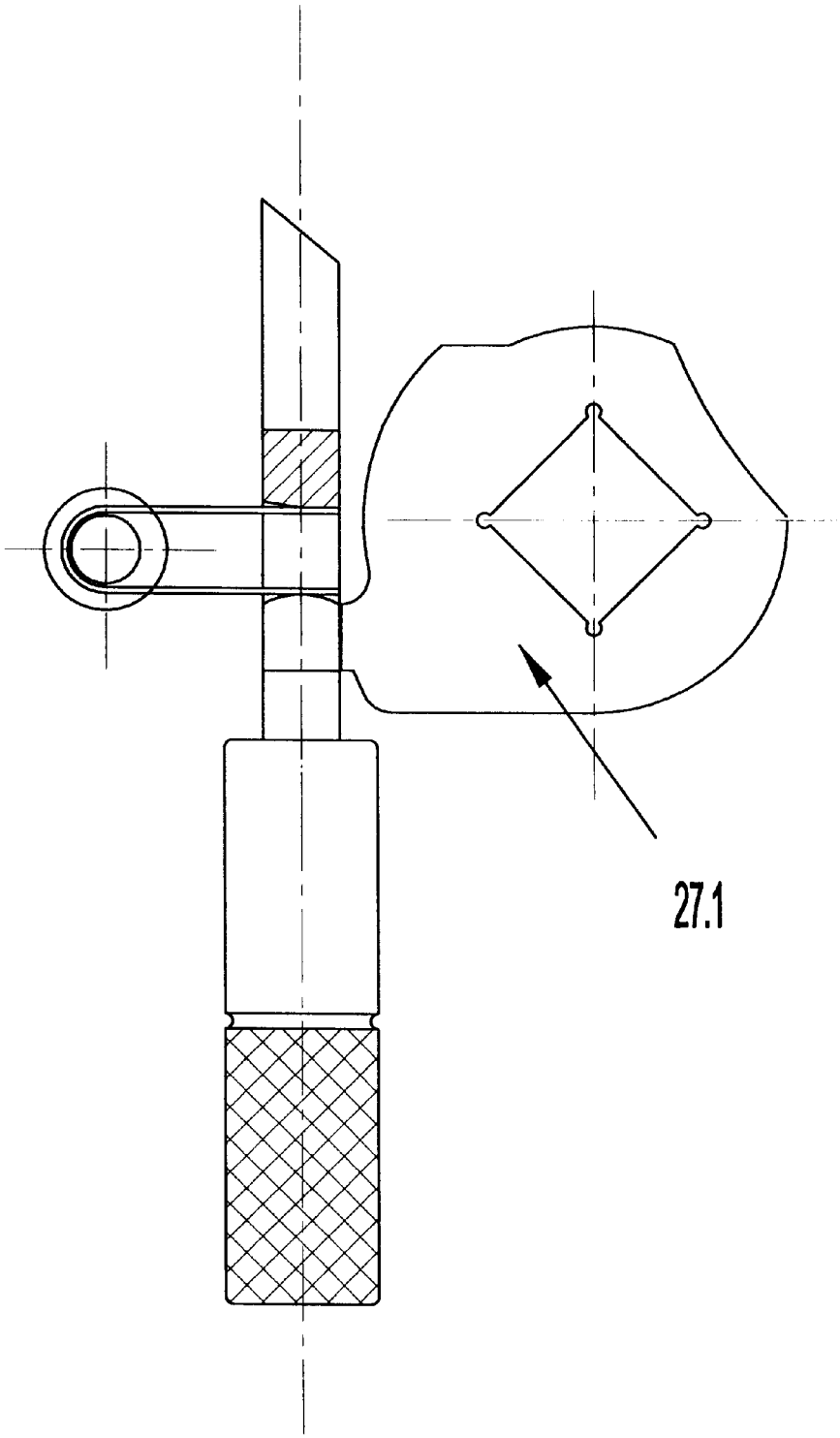
FIG. 16 shows a view similar to that of FIG. 14 but with the locking cam of the inventive wire lock in the locked position thereof.

FIG. 16 shows a view similar to that of FIG. 14 but including the locking cam 27.1 bearing against a side of the end 62 of the end piece 26 precluding rotation thereof which precludes removal from the casing 21.

Figure 17:
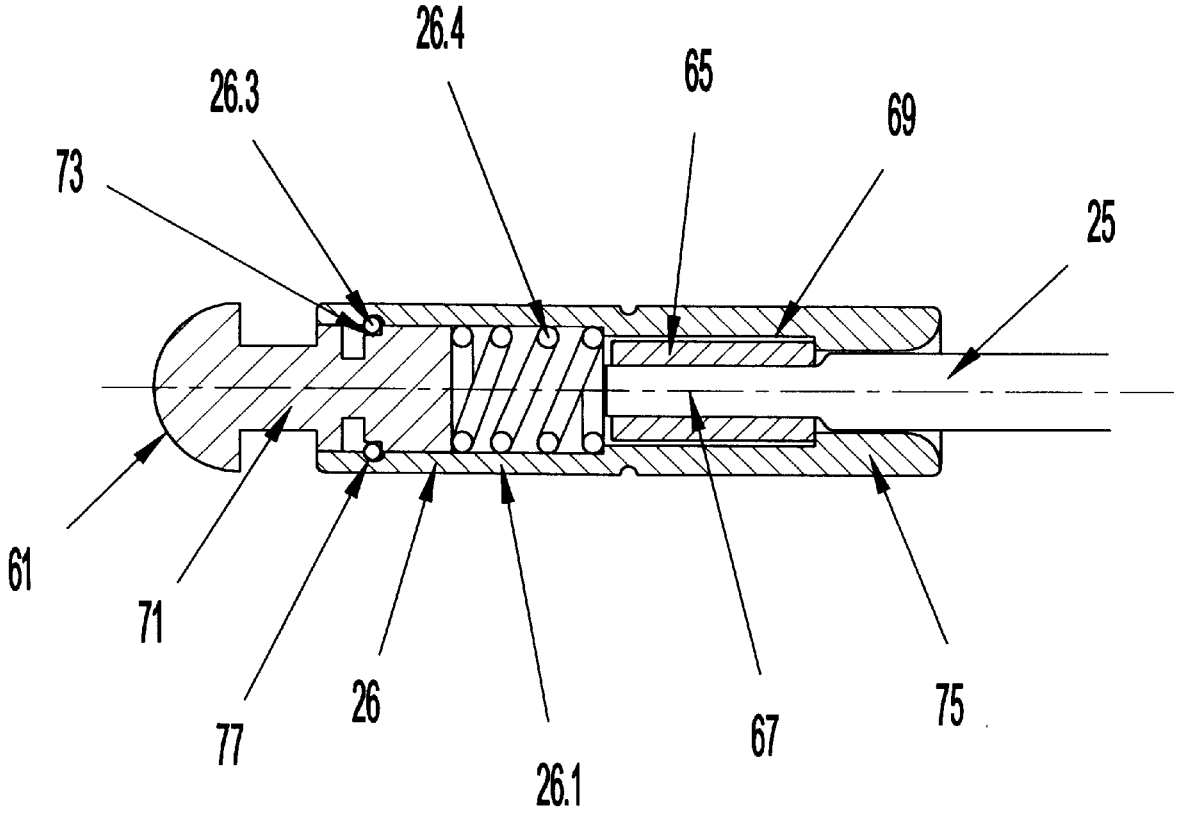
FIG. 17 shows a longitudinal cross-sectional view through the end piece of the cable of the embodiment of FIG. 13.

With reference, now, to FIG. 17, certain modified details concerning the assembly of the end piece 26 to the cable 25 will now be described. As seen in the cross-sectional view of FIG. 17, the end piece 26 includes a sleeve 26.1 surrounding the distal end of the cable 25. The nipple 65 is pressed onto the cable 25 to form an effective anchor for the end piece 26. In its pressed form, the nipple has a slightly smaller outer diameter than the inside diameter 69 of the sleeve 26.1 so that the end piece 26 can be rotated freely with respect to the cable 25 to therefore prevent kinks from forming in the cable 25 and to prevent internal twisting loads from being introduced into the cable 25 when the end piece 26 is rotated 90° during the locking procedure. Through this structure, elimination of internal twist loads in the cable 25 prevent the end piece 71 from twisting and falling out of the locking sleeve 21 before the key (not shown) has been rotated to lock the lock 17 and therefore block the end piece 26 from being removed. The sleeve 26.1 is machined to provide a slight clearance for the nipple 65.

The fitting 71 can be rotated into the sleeve 26.1 and the force needed to twist the fitting 71 is determined by the restoring force of the spring 26.4. This safety feature prevents internal parts of the locking device from being damaged by extreme twisting of the sleeve 26.1 with a tool or other device. Since the spring 26.4 is pushing the fitting 71 against the C-shaped locking ring 26.3, the locking ring 26.3 through its internal expanding action moves out from its recess 77 into the sleeve 26.1 thereby preventing the spring 26.4 from pushing the fitting 71 out from the sleeve 26.1. This action transfers traction force from the cable 25 via the sleeve 26.1 to the fitting 71. Through the design of the components as shown in FIG. 17, the cable 25 cannot put any twisting force on the fitting 71. The twisting force transferred to the fitting 71 can only come from the sleeve 26.1 and is controlled by the spring force of the calibrated spring 26.4.

With the structure as shown in FIG. 17, the user may grip the periphery of the sleeve 26.1, may insert the end 61 of the fitting 71 into the casing 21, may rotate the end 61 90° and may use the key A in the lock 17 to lock the end 61 within the casing 21. Thereafter, the cable 25 and the nipple 65 may freely rotate with respect to the sleeve 26.1 without applying any rotative forces to the fitting 71. In this way, an intruder or thief will have a more difficult time attempting to remove the fitting 71 from the casing 21. Additionally, this slip coupling makes it easier to extend the cable 25 around an object while avoiding twisting of the cable 25.

Figure 18:
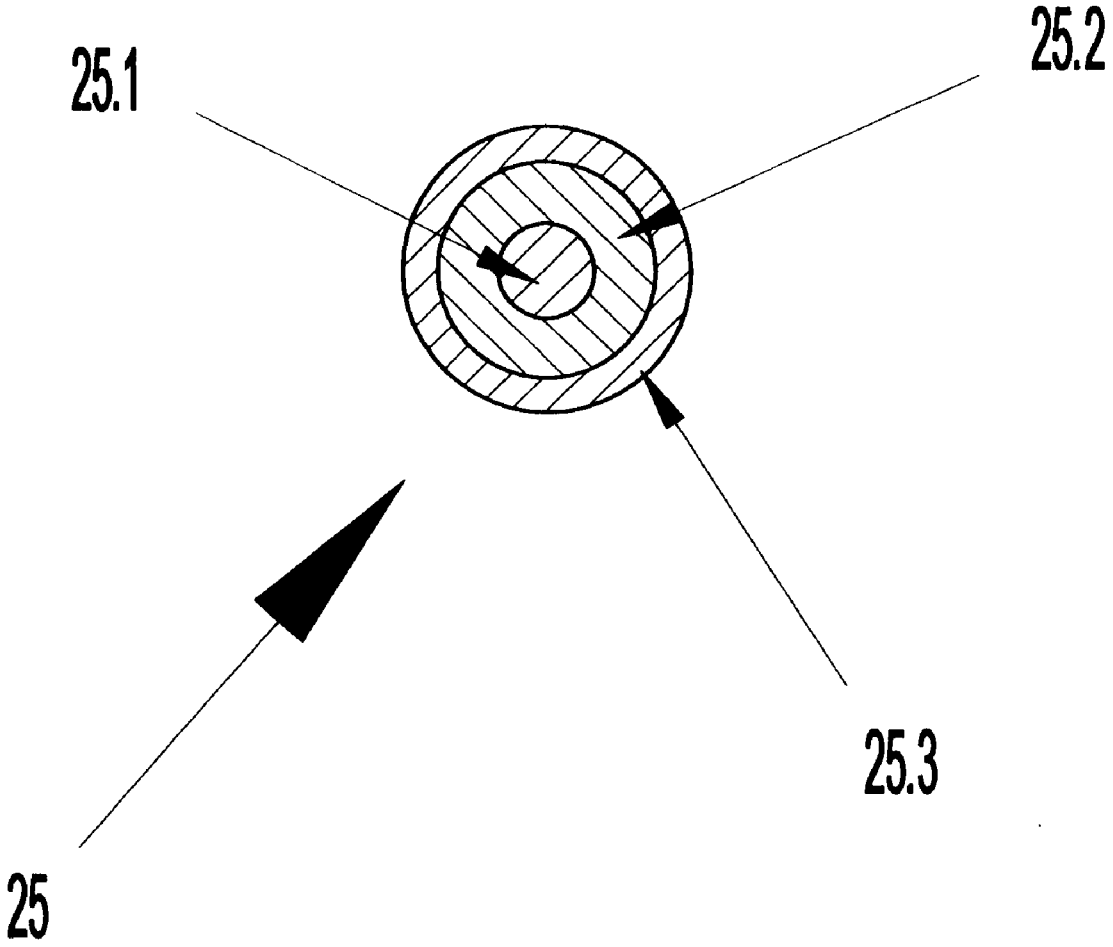
FIG. 18 shows a cross-sectional view through the cable itself showing the different layers thereof.

With reference to FIG. 18, the cable 25, in the fourth embodiment, is preferably made of three layers, a central core made of a flexible stainless steel wire, braided on its outer periphery with aramid fibers 25.2 such as those made under the Trademark "KEVLAR", with the outer periphery of the "KEVLAR" layer being surrounded by a braided layer 25.3 of polyester fibers to protect the "KEVLAR" fibers from the deliterious effect of ultraviolet radiation, and also to reduce friction from engagement of the outer polyester layer 25.3. The outer cover 25.3 protects the "KEVLAR" layer from damage and from being scratched and, additionally, the polyester layer 25.3 may be made in any one of a large number of color choices.

Figure 19:
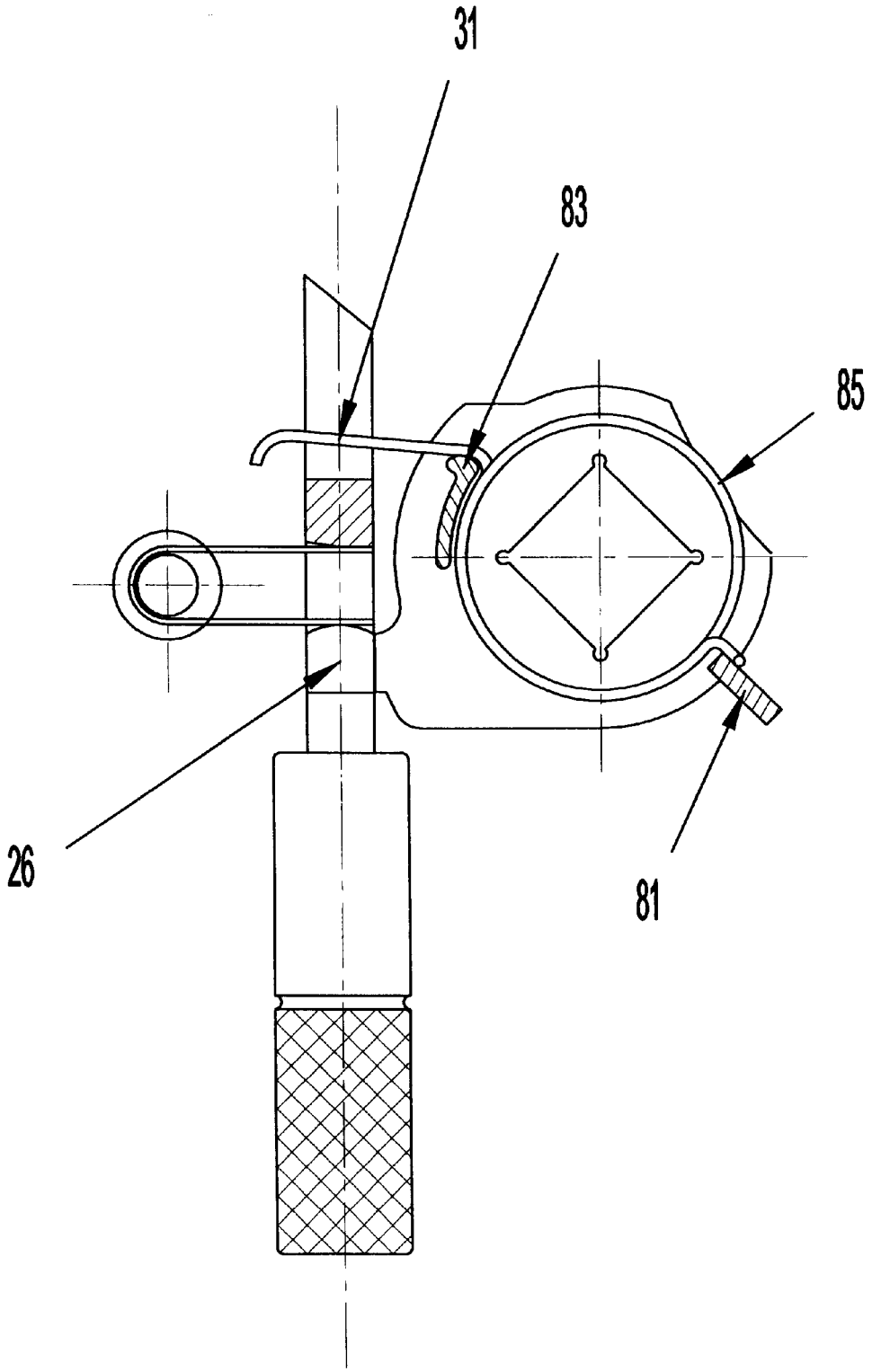
FIG. 19 shows a view similar to that of FIG. 16 but with details of a cam lifting lobe and a spring anchor point shown in detail with the locking cam in the locked position thereof.
Figure 20:
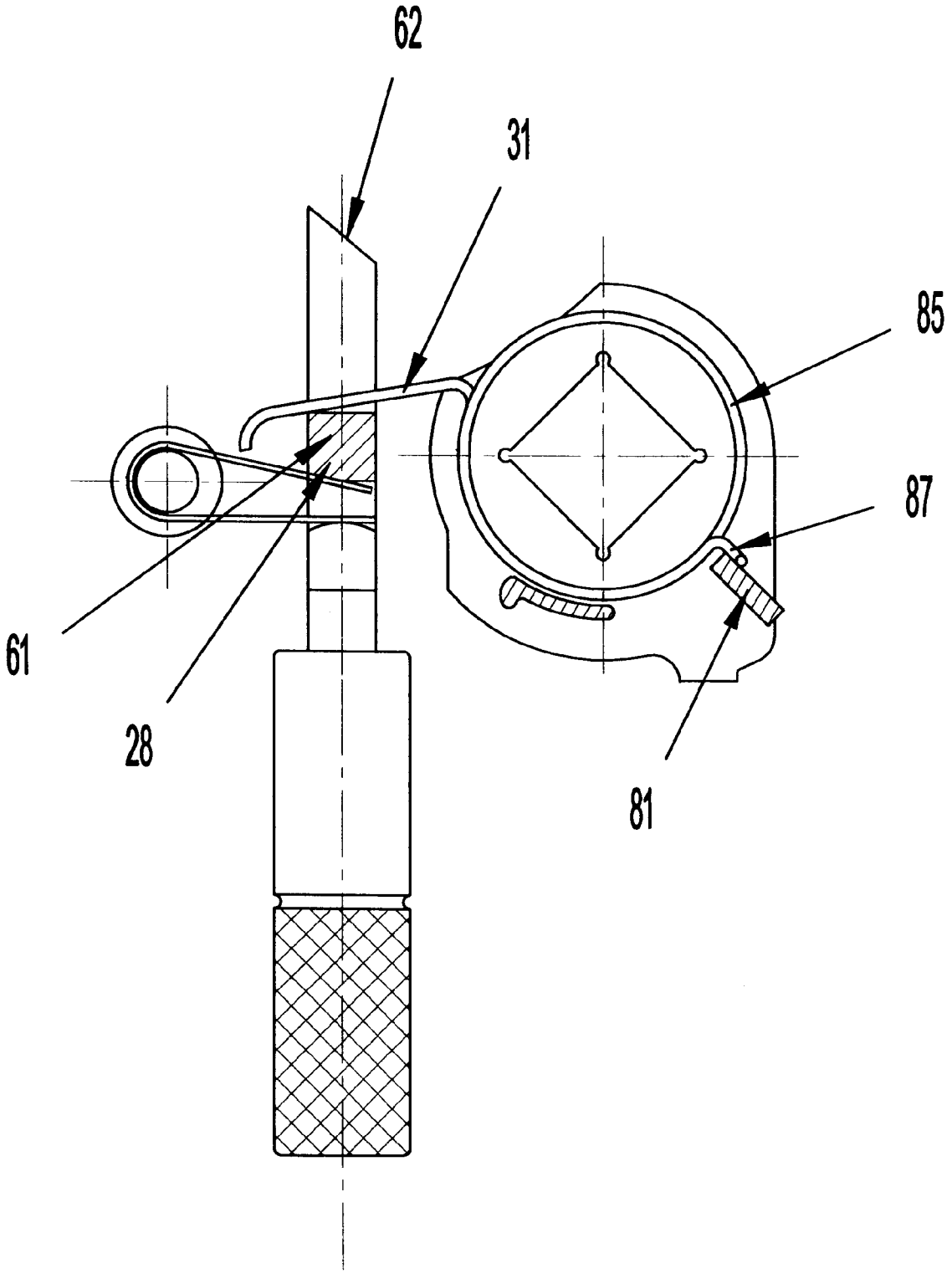
FIG. 20 shows a view similar to that of FIG. 19 but with the locking cam in the open position thereof.

In a further aspect, with reference to FIGS. 19 and 20, the inventive wire lock is provided with a safety system that absolutely prevents the user from leaving the cable 25 in a strapped position without first turning the key A to a locked position and removing the key. This safety system protects the user by preventing unintentional misuse, for example, should a child be playing with the inventive wire lock 100.

With reference to FIGS. 19 and 20, the casing 21 is provided with an anchoring point 81 which anchors one end of a coil spring 85, which ends are designated by the reference numerals 87 and 31. The reference numeral 83 refers to a cam lobe integral with the locking cam 27.1 and engaging the end 31 of the spring 85. As seen in FIG. 20, in the position of the locking cam 27.1 described as the unlocked open position, the end 31 of the spring 85 bears against the cross member 61 of the bar pawl 28 moving its distal end 62 away from engagement with the gear teeth of the drum 22 thus blocking the end 62 from engaging the teeth of the drum 22.

With reference to FIG. 19, when the locking cam 27.1 is rotated to the locked position precluding rotation of the end piece 26, the end 31 of the spring 85 is lifted away from the cross member 61 of the bar pawl 28 by the cam lobe 83 so that the bar pawl 28 can operate in the manner described hereinabove, particularly with reference to FIGS. 14 and 15.

I claim:

1. A locking device for securing unattached objects to a stationary part of a building or for locking objects to one another, comprising a lock casing (1) in which a drum (2) is mounted for rotation during unwinding and winding-on of a strap, a line, or a wire (5), a free end of which being provided with an end piece (6) adapted to be inserted into an opening in the lock casing (1) and to be secured against undesired removal with the aid of a lock (7), the drum (2) being connected to a knob (9) by means of which the strap, line or wire (5) may be wound onto the drum (2) and be tensioned by a desired tensioning force, wherein blocking means (2, 8) are provided for blocking the drum against rotation in an unwinding direction, said blocking means being internal within said casing and coupled to the lock (7) whereby when said lock (7) is locked, said drum is simultaneously blocked against rotation in said unwinding direction, said knob (9) being connected to said drum (2) through a coupling means (2.2, 9.2) forming a part of said drum (2), and further including a compression spring (9.3) disposed between a bottom of said lock casing (1) and said knob (9) or between said drum (2) and said knob (9), whereby said knob (9) is biased away from said drum (2) so that in a non-actuated condition, said coupling means (2.2, 9.2) is uncoupled.

2. A locking device as claimed in claim 1, wherein said knob (9) is structurally related to the drum (2) such that in a first position, said knob (9) is disconnected from the drum (2), and in a second position, said knob (9) is coupled with the drum (2) to facilitate transfer of rotational force from the knob (9) to the drum (2).

3. A locking device as claimed in claim 1, wherein the drum (2) carries at least one gear (2.1) which in a locked position engages a bar pawl (8) whereby, when a pulling force is exerted on the wire (5), the drum (2) is blocked against rotation, the bar pawl (8) being connected to a locking arm (7.1) on the lock (7) through a spring means (8.3) and the bar pawl (8) being arranged to be out of contact with the gear (2.1) when the locking arm (7.1) is in an opened position, in that the locking arm (7.1) is in engagement with an end piece (6) on the wire (5) in the locked position, and in that by means of the spring means (8.3) the bar pawl (8) is arranged to ride across the teeth of the gear (2.1) upon tensioning of the wire (5) with the aid of the knob (9).

4. A locking device as claimed in claim 1, wherein the drum supports at least one gear (12.3, 12.4) which engages a bar pawl (18) in a blocking position, said pawl (18) being arranged, upon pulling action exerted on the wire (15), to block the drum (12) against rotation, an end piece (16) on the wire (15), when inserted into the lock casing (11), being arranged to move the bar pawl (18) to said blocking position through a spring means (18.2), and in that with the aid of the spring means (18.2) the bar pawl (18) is permitted to ride across teeth of the gear (12.3, 12.4) upon tensioning of the wire (15) by rotation of the knob (9).

5. A locking device as claimed in claim 3, wherein the end piece (16) includes a T-shaped end having a rectangular cross-sectional configuration, the T-shaped end comprising a cross bar extending at right angles to a longitudinal direction of extension of the end piece (16), the lock casing (11) having a matching rectangular opening, and in that in the locked position, the end piece (16) is turned 90° to bring the end piece cross bar into engagement with the lock casing (11) and thus to absorb traction force of the wire (5).

6. A locking device as claimed in claim 3, wherein in the locked position, the end piece (16) is held against rotation on one hand by the locking arm (17.1) and on the other hand by abutment against a stationary part (11.3) of the lock casing (11).

7. In a locking device having a casing, a drum rotatably contained in said casing, a length of cable having a first end attached to said drum and a second end remote therefrom, said cable extending through a first opening in said casing, said second end of said cable being receivable in a second opening in said casing and locking means for releasably locking said second end of said cable in said second opening, the improvement comprising coupling means interposed between said locking means and said drum for restraining said drum from rotation in an unwinding direction of said cable when said locking means is in a locked position precluding removal of said second end of said cable from said second opening, said coupling means including an H-shaped bar pawl including two legs and a cross member, said bar pawl having a first end facing said drum and a second end facing said second opening, said bar pawl being biased toward said drum by a first spring engaging between said bar pawl cross member and said second opening, said drum having circumferentially spaced ratchet teeth engageable with said first end of said bar pawl, said bar pawl being biased toward said second end to a position disengaging said first end of said bar pawl from said teeth by a second spring, whereby when said second end of said cable is removed from said second opening, said second spring biases said first end of said bar pawl away from said drum teeth permitting free unwinding of said cable from said drum, and whereby when said second end of said cable is within said second opening, said second end of said cable moves said first end of said bar pawl into engagement with said drum teeth, said first spring permitting said teeth to ride over said bar pawl first end solely in a rotative direction of said drum winding said cable thereon.

8. The locking device of claim 7, wherein at least one of said legs has an inwardly directed protrusion adjacent said second opening, said second spring engaging said protrusion.

9. The locking device of claim 7, wherein said first spring is U-shaped including first and second legs, said first leg engaging said cross member.

10. The locking device of claim 7, wherein said cable second end includes an end piece coupled to said second end for free rotation with respect thereto.

11. The locking device of claim 10, wherein said end piece includes a nipple pressed over a termination of said second end of said cable, an end member including a rounded end and a sleeve capturing said end member and said nipple, said sleeve and end member being rotatable with respect to said nipple.

12. The locking device of claim 7, wherein said cable has an inner core of stainless steel covered by a layer of aramid fibers covered by a plastic cover.

13. The locking device of claim 12, wherein said inner core comprises braided stainless steel wire.

14. The locking device of claim 13, wherein said aramid fiber comprises a material sold under the Trademark "KEVLAR".

15. The locking device of claim 14, wherein said plastic cover comprises polyester.

16. The locking device of claim 9, wherein said locking means includes a locking cam rotatable to a position precluding removal of said second end of said cable from said second opening, said first leg of said first spring engaging a first side of said cross member, said locking cam carrying a third spring having an end engageable with a second side of said cross member when said locking cam is in an unlocked position, thereby uncoupling said first end of said bar pawl from said teeth.

17. The locking device of claim 2, wherein the drum (2) carries at least one gear (2.1) which in a locked position engages a bar pawl (8) whereby, when a pulling force is exerted on the wire (5), the drum (2) is blocked against rotation, the bar pawl (8) being connected to a locking arm (7.1) on the lock (7) through a spring means (8.3) and the bar pawl (8) being arranged to be out of contact with the gear (2.1) when the locking arm (7.1) is in an opened position, in that the locking arm (7.1) is in engagement with an end piece (6) on the wire (5) in the locked position, and in that by means of the spring means (8.3) the bar pawl (8) is arranged to ride across the teeth of the gear (2.1) upon tensioning of the wire (5) with the aid of the knob (9).

18. The locking device of claim 2, wherein the drum supports at least one gear (12.3, 12.4) which engages a bar pawl (18) in a blocking position, said pawl (18) being arranged, upon pulling action exerted on the wire (15), to block the drum (12) against rotation, an end piece (16) on the wire (15), when inserted into the lock casing (11), being arranged to move the bar pawl (18) to said blocking position through a spring means (18.2), and in that with the aid of the spring means (18.2) the bar pawl (18) is permitted to ride across teeth of the gear (12.3, 12.4) upon tensioning of the wire (15) by rotation of the knob (9).

* * * * *